US008515296B2

(12) United States Patent
Takahashi

(10) Patent No.: US 8,515,296 B2
(45) Date of Patent: Aug. 20, 2013

(54) DEVELOPER SUPPLYING DEVICE, DEVELOPING DEVICE, AND IMAGE FORMING APPARATUS

(75) Inventor: Yasufumi Takahashi, Machida (JP)

(73) Assignee: Ricoh Company, Limited, Tokyo (JP)

( * ) Notice: Subject to any disclaimer, the term of this patent is extended or adjusted under 35 U.S.C. 154(b) by 301 days.

(21) Appl. No.: 12/830,744

(22) Filed: Jul. 6, 2010

(65) Prior Publication Data

US 2011/0020017 A1 Jan. 27, 2011

(30) Foreign Application Priority Data

Jul. 21, 2009 (JP) ..... 2009-169845
Apr. 27, 2010 (JP) ..... 2010-102321

(51) Int. Cl.
*G03G 15/08* (2006.01)

(52) U.S. Cl.
USPC ..... 399/30; 399/27; 399/28; 399/29; 399/58; 399/61; 399/62; 399/63; 399/259

(58) Field of Classification Search
USPC ..... 399/27–30, 58, 61–63, 259
See application file for complete search history.

(56) References Cited

U.S. PATENT DOCUMENTS 4,640,129 A * 2/1987 Miyakawa et al. ..... 399/63
5,604,575 A * 2/1997 Takagaki et al. ..... 399/359
2001/0022901 A1* 9/2001 Suetsugu ..... 399/57
2004/0013963 A1 1/2004 Muramatsu et al.
2006/0251983 A1 11/2006 Muramatsu et al.
2007/0280742 A1* 12/2007 Matsumoto et al. ..... 399/258
2008/0181670 A1 7/2008 Tsuda et al.
2009/0226221 A1 9/2009 Takahashi

FOREIGN PATENT DOCUMENTS

| | | |
|---|---|---|
| JP | 2000-338767 | 12/2000 |
| JP | 2003-330218 | 11/2003 |
| JP | 3691489 | 6/2005 |
| JP | 2007-322916 | 12/2007 |
| JP | 2008-102478 | 5/2008 |

* cited by examiner

*Primary Examiner* — Ryan Walsh
(74) *Attorney, Agent, or Firm* — Oblon, Spivak, McClelland, Maier & Neustadt, L.L.P.

(57) ABSTRACT

The developer supplying device supplies a supplementary developer including a toner and a carrier in a predetermined weight ratio. The developer supplying device includes a supplementary developer container containing the supplementary developer, and a supplementary developer feeding passage configured to feed the supplementary developer from the supplementary developer container to a developing device. The supplementary developer container is replaced when the supplementary developer is substantially exhausted. The developer supplying device further includes a carrier concentration determining device provided on the supplementary developer feeding passage to determine the concentration of the carrier in the supplementary developer fed through the supplementary developer feeding passage, and a residual supplementary developer amount estimating device configured to estimate the amount of the supplementary developer remaining in the supplementary developer container.

12 Claims, 14 Drawing Sheets

DEVELOPER SUPPLYING DEVICE, DEVELOPING DEVICE, AND IMAGE FORMING APPARATUS

BACKGROUND OF THE INVENTION

1. Field of the Invention

The present invention relates to a developer supplying device for supplying a developer to a developing device. In addition, the present invention relates to a developing device, which develops an electrostatic latent image with a developer to form a visual image and which uses the developer supplying device. Further, the present invention relates to an image forming apparatus which forms a visual image using the developing device.

2. Discussion of the Background

In conventional electrophotographic image forming apparatus, which have been used for copiers, printers, facsimiles, etc., an electrostatic latent image is formed on an image bearing member (such as photoreceptor drums and belts) according to image information, and the electrostatic latent image is developed with a developing device having a developer bearing member to form a visual image (i.e., toner image) on the image bearing member. In this regard, two-component developing devices using a two-component developer including a toner and a carrier are broadly used as the developing device because of having advantages such that toner images having good transferability, and half-tone reproducibility can be stably produced even when environmental conditions such as temperature and humidity vary.

Two-component developing devices develop electrostatic latent images using a developer including a toner and a carrier. In this case, only the toner is used for forming visual images. Therefore, it is necessary to supply the toner to the developing devices as the amount of toner included in the developer decreases. In this regard, replaceable toner containers (such as bottles) are typically used for supplying toner. Among various toner containers, toner bottles having a spiral groove on a surface thereof are broadly used because of having a good combination of toner supplying stability and toner feeding efficiency.

Among such toner bottles having a spiral groove, the following toner bottle is well known. Specifically, the toner bottle has a cylindrical main body, a closed bottom portion formed on one side of the main body, and a narrowed mouth portion which is provided on the side of the main body opposite to the bottom portion and from which a toner is to be discharged. A continuous spiral group is formed on an inner surface of the main body while extending from the bottom portion to the mouth portion so that when the toner bottle is rotated, the toner in the bottle is fed to the outside through the mouth portion. In addition, a projection is formed at a position of the outer surface of the bottom portion apart from the central axis of the bottle so that a rotating force is transmitted to the toner bottle via the projection. Since the toner in the toner bottle is moved to the exit (i.e., the mouth portion) as the toner bottle is rotated, the toner can be stably supplied. The toner thus supplied from the toner bottle is guided to a developing device by means of a screw or free-fall of the toner due to gravity.

When development operations are repeatedly performed for a long period of time using a two-component developer, a problem in that the coating layer of the carrier in the developer is abraded or components of the toner adhere to the coating layer, resulting in deterioration of the charging ability of the carrier is caused. In this case, a background development problem such that images whose background area is soiled with the toner are produced, and a toner scattering problem in that the toner is scattered around the developing device, resulting in contamination of the parts of the image forming apparatus are caused. Therefore, the developer has to be replaced with a fresh developer at certain intervals.

In attempting to solve the problems (i.e., to prevent deterioration of developer and to prolong the developer replacement interval), a supplementary developer supplying method in which a mixture of a toner and a carrier is supplied to a developing device while discharging an excess of the developer in the developing device to gradually replace the carrier with a fresh carrier is used now. There is a developer supplying device using this supplementary developer supplying method, which includes a developer container, part or entire of which is deformable, and a pump which sucks the developer contained in the container together with air to feed the developer to a developing device.

When no developer remains in a developer bottle in such image forming apparatus, the image forming apparatus judges that the developer is exhausted and requests a user to replace the developer bottle, in order to prevent occurrence of a toner concentration decreasing problem. In this regard, many image forming apparatus indicate that the developer is in a near-end state for safety before such developer-end judgment.

FIG. 15 is a graph showing the relation between the amount of residual developer and developer feeding capacity of a developer supplying device. It can be understood from FIG. 15 that the developer feeding capacity starts to decrease when the amount of residual developer is about 300 g, and thereafter the developer feeding capacity decreases in proportion to the amount of residual developer. It can be understood from this graph that the method for determining the amount of residual developer only from the developer feeding time (see JP-A 2000-338767) is difficult particularly when the developer is in a near-end state.

A direct optical detection method such that the fed toner is directly detected with an optical sensor is used for determining the amount of fed toner. In this method, a detection window is provided in a toner passage of a toner feeding member, and a glass tube is provided inside the detection window while setting an optical sensor outside the detection window to detect whether the toner is present in the glass tube. The detection results are used for judging whether the toner is exhausted. However, this method has a drawback in that when the glass tube tends to be contaminated with the toner, and thereby misdetection is caused.

The above-mentioned method proposed by JP-A 2000-338767 in which the amount of residual toner is determined depending on the integration value of the toner supplying time is not accurate when the toner is in a near-end state because the toner feeding amount largely varies at the toner near-end. In addition, as illustrated in FIG. 15, when the amount of residual toner is small, the amount of toner fed from the toner bottle per a unit time decreases. Therefore, the amount of residual toner cannot be precisely determined from the integration value of the toner supplying time at the toner near-end.

For these reasons, the inventor recognized that there is a need for a developer supplying device, which can precisely determine the amount of residual developer in a developer container.

SUMMARY OF THE INVENTION

This patent specification describes a novel developer supplying device configured to supply a supplementary developer, which includes a toner and a carrier in a predetermined weight ratio, to a developing device. The developer supplying device includes a supplementary developer container containing the supplementary developer, and a supplementary developer feeding passage configured to feed the supplementary developer from the supplementary developer container to a developing device. The supplementary developer container is replaced when the supplementary developer is substantially exhausted. The developer supplying device further includes a carrier concentration determining device, which is provided on the supplementary developer feeding passage to determine the concentration of the carrier in the supplementary developer fed through the supplementary developer feeding passage, and a residual supplementary developer amount estimating device configured to estimate the amount of residual supplementary developer in the developer container on the basis of the carrier concentration.

This patent specification further describes a novel developing device. The developing device includes the above-mentioned developer supplying device, a developer containing portion configured to contain a developer, an agitating member configured to agitate and feed the developer, and a developer bearing member configured to bear the developer to develop an electrostatic latent image with the developer. The supplementary developer is supplied from the supplementary developer container of the developer supplying device to the developer containing portion by the developer supplying device to be mixed with the developer.

This patent specification further describes a novel image forming apparatus. The image forming apparatus includes an image bearing member configured to bear an electrostatic latent image thereon, and the above-mentioned developing device configured to develop the electrostatic latent image with the developer to form a visual image on the image bearing member.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 11:
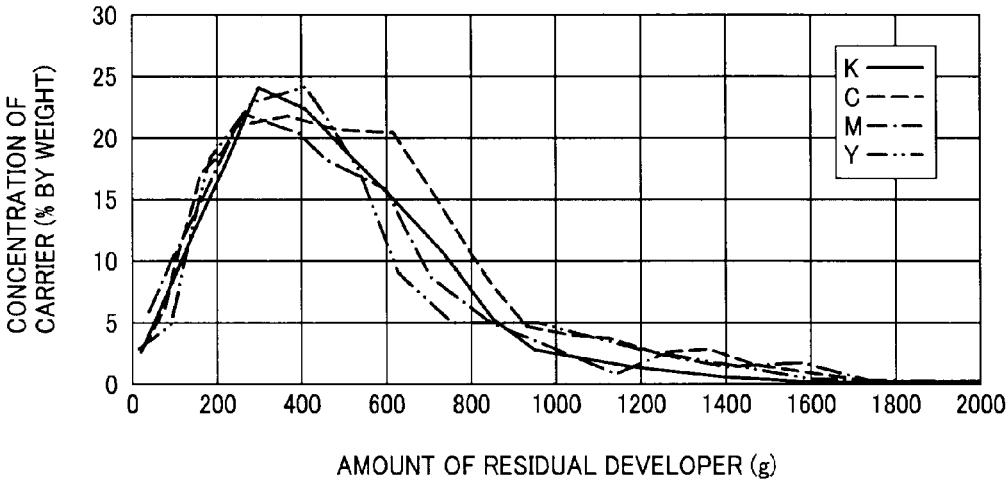
FIG. 11 is a graph showing the relation between the amount of residual developer and the concentration of carrier in the fed developer.

The present inventor has investigated to solve the above-mentioned problems. As a result of the investigation, the following is discovered. Specifically, in a case where a supplementary developer including a toner and a carrier is supplied from a developer container to a developing device, the concentration of the carrier included in the supplementary developer fed from the developer container increases as the amount of residual supplementary developer in the developer container decreases due to difference in specific gravity of the toner and the carrier as illustrated in FIG. 11. In this regard, the carrier concentration means the concentration of the carrier included in the residual supplementary developer in the developer container, and varies depending on the shape of the developer container, the supplementary developer filling method used, etc. However, as a result of the present inventor's experiments, it is found that under the same conditions, the carrier concentration varies as illustrated in FIG. 11. Therefore, the amount of residual supplementary developer included in the developer container can be estimated on the basis of this carrier concentration curve.

The present invention will be described in detail. The present invention relates to a developer supplying device, which supplies a supplementary developer including a toner and a carrier in a predetermined weight ratio to a developing device and which is used for an image forming apparatus using a two-component developing method.

The developer supplying device includes a supplementary developer container, and a developer feeding passage which feeds a developer from the developer container to a developing device. The developer container contains a supplementary developer including a toner and a carrier in a predetermined weight ratio, and is replaced when the supplementary developer therein is exhausted. The developer supplying device further includes a carrier concentration determining device, which is provided on the supplementary developer feeding passage to determine the concentration of the carrier (i.e., the inverse number of the toner concentration) in the supplementary developer fed through the supplementary developer feeding passage, and a residual supplementary developer amount estimating device configured to estimate the amount of residual supplementary developer in the developer container on the basis of the carrier concentration.

The residual supplementary developer amount estimating device estimates at least one of "end" of the supplementary developer in the developer container (i.e., empty container) and "near-end" of the supplementary developer on the basis of the detected carrier concentration. The carrier concentration determining device measures the permeability of the supplementary developer without contacting the supplementary developer. The carrier concentration determining device is arranged on a horizontally extending portion of the supplementary developer feeding passage.

In the developer supplying device, the supplementary developer is fed with a pump utilizing pressure difference such as single-axis eccentric screw pump.

In the explanation below, the term "near-end" means that the supplementary developer in the developer container (such as toner bottles) is exhausted or substantially exhausted, and the term "end notification" means to notify the user of the information that the supplementary developer in the developer container is exhausted or substantially exhausted, or the developer container should be replaced.

At first, an image forming apparatus, which is an embodiment of the present invention, will be described with reference to FIGS. 1-4.

Figure 1:
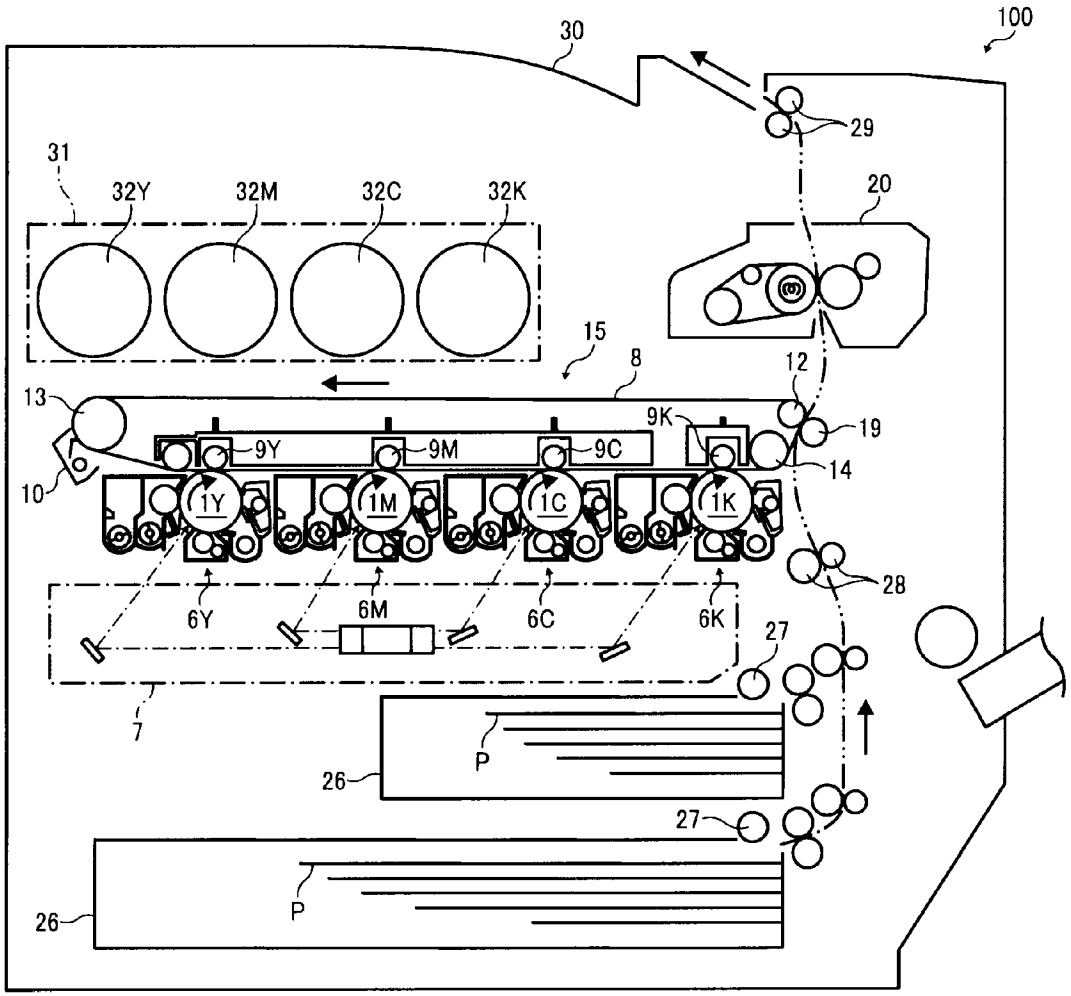
FIG. 1 is a schematic view illustrating an image forming apparatus of an embodiment of the present invention.
Figure 2:
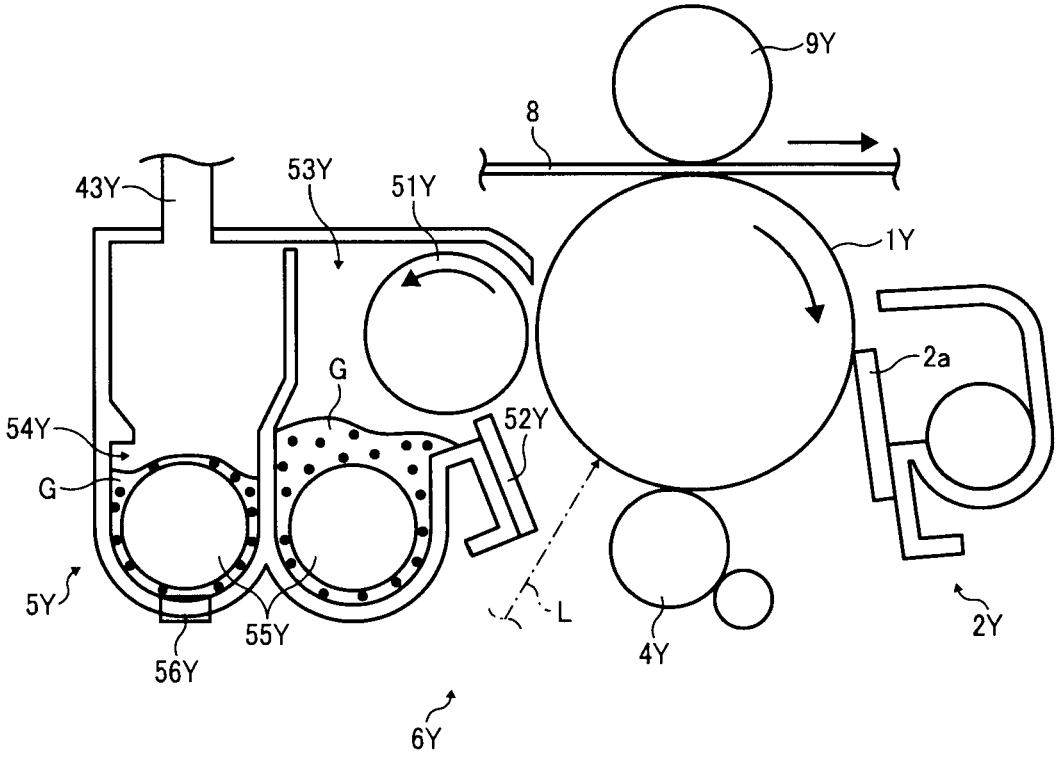
FIG. 2 is a schematic view illustrating an image forming section of the image forming apparatus.
Figure 3:
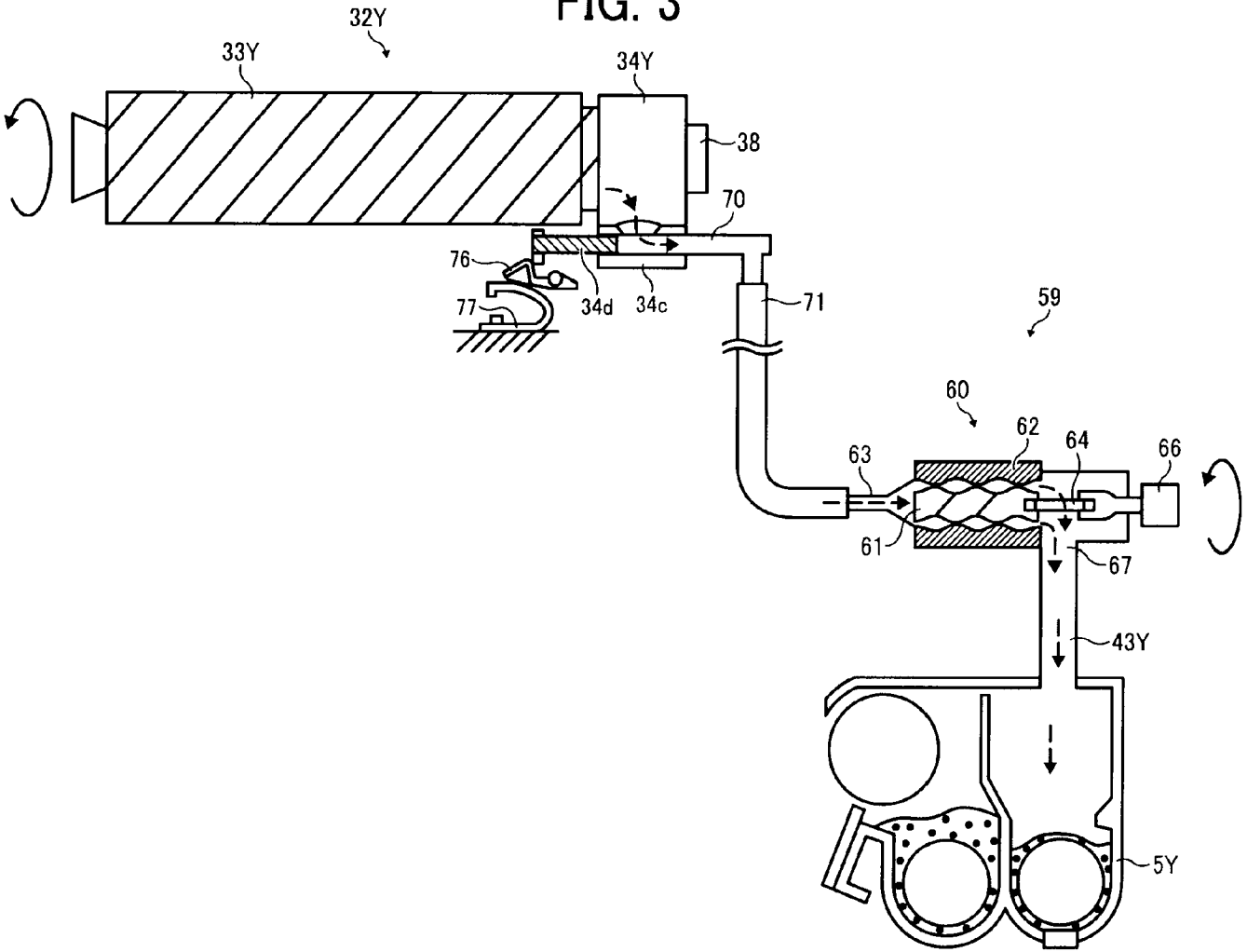
FIG. 3 is a schematic view illustrating a supplementary developer supplying passage of the image forming apparatus.
Figure 4:
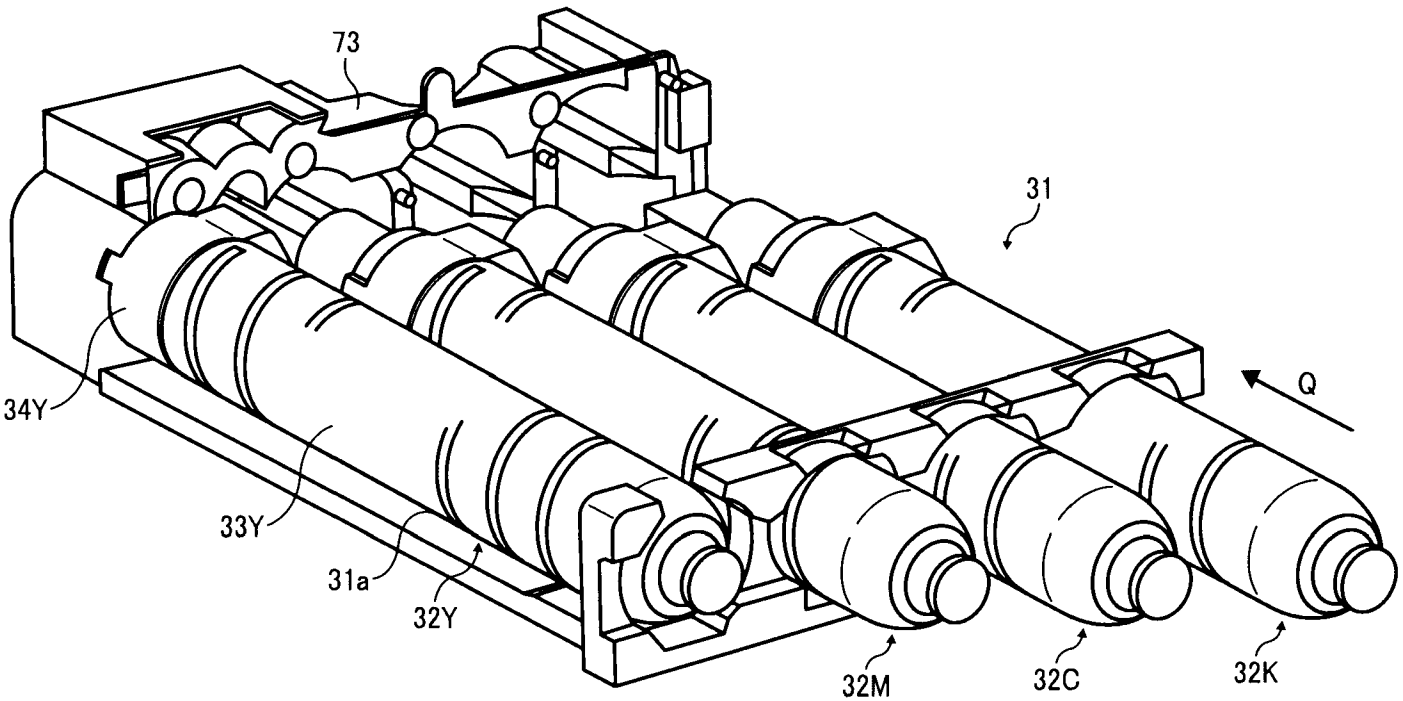
FIG. 4 is a schematic perspective view illustrating a supplementary developer container containing portion of the image forming apparatus.

FIG. 1 is an overall view of a printer, which is an example of the image forming apparatus. FIG. 2 is an enlarged view of the image forming section of the printer. FIG. 3 illustrates the developer feeding passage of the printer. FIG. 4 is a perspective view illustrating a portion of the developer supplying device of the printer.

Figure 7:
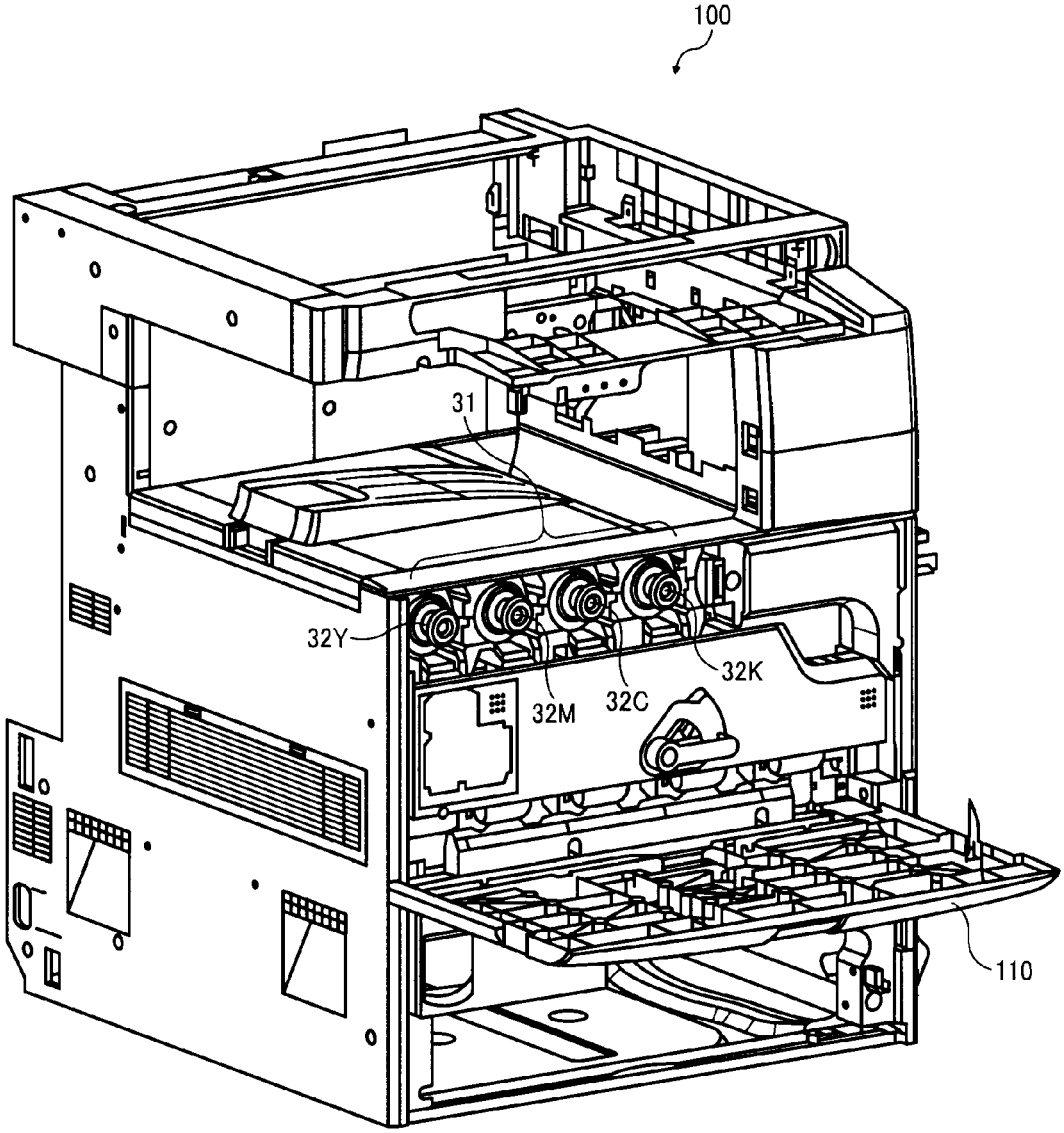
FIG. 7 is a schematic perspective view illustrating the image forming apparatus in which the door of the main body thereof is opened.

Referring to FIG. 1, a developer container containing portion 31, to which four color developer containers 32Y, 32M, 32C and 32K containing yellow, magenta, cyan and black color developers, respectively, are detachably attached, is provided in an upper portion of an image forming apparatus 100 (see also FIG. 7). In addition, an intermediate transfer unit 15 is arranged below the developer container containing portion 31. Further, yellow, magenta, cyan and black color image forming sections 6Y, 6M, 6C and 6K are arranged side by side so as to face an intermediate transfer belt 8 of the intermediate transfer unit 15.

Referring to FIG. 2, the yellow image forming section 6Y includes a photoreceptor drum 1Y serving as an image bearing member, and a charging device 4Y, a developing device 5Y, a cleaning device 2Y and a discharging device (not shown), which are arranged around the photoreceptor drum. Image forming processes such as charging process, light irradiating process, developing process, transferring process, and cleaning process are performed on the photoreceptor drum 1Y to form a yellow toner image on the photoreceptor drum. Similarly to the yellow image forming section, the magenta, cyan and black color image forming sections perform the same image forming processes except that the color (Y) of the toner is changed to magenta, cyan or black color, thereby forming magenta, cyan and black color images on the respective photoreceptor drums 1M, 1C and 1K. Therefore, hereinafter the yellow image forming section 6Y is mainly described while properly omitting description of the other image forming sections 6M, 6C and 6K.

Referring to FIG. 2, the photoreceptor drum 1Y is rotated by a driving motor (not shown) in a direction indicated by an arrow. The charging device 4Y evenly charges the surface of the photoreceptor drum 1Y (charging process). Next, a light irradiating device 7 (illustrated in FIG. 1) irradiates the charged photoreceptor drum 1Y with laser light L to form an electrostatic latent image, which corresponds to the yellow image to be produced, on the photoreceptor drum 1Y (light irradiating process). In this regard, laser light L emitted by a light source of the light irradiating device is guided to a rotated polygon mirror. Laser light L reflected from the rotated polygon mirror scans the charged surface of the photoreceptor drum 1Y after passing through plural optical devices to form an electrostatic latent image.

When the thus formed electrostatic latent image is fed to a development region, in which the photoreceptor drum 1Y is opposed to the developing device 5Y, the latent image is developed with the developing device using a developer including a yellow toner, resulting in formation of a yellow toner image on the photoreceptor drum 1Y (developing process).

When the yellow toner image is fed to a transfer position, in which the photoreceptor drum 1Y is opposed to the intermediate transfer belt 8 and a primary transfer bias roller 9Y, the yellow toner image is transferred onto the surface of the intermediate transfer belt 8 (primary transfer process). In this regard, a small amount of yellow toner particles remain on the photoreceptor drum 1Y without being transferred.

Thereafter, the surface of the photoreceptor drum 1Y is fed to a cleaning position, in which the photoreceptor drum is opposed to the cleaning device 2Y, and the residual yellow toner is mechanically collected with a cleaning blade 2*a* (cleaning process). Finally, charges remaining on the surface of the photoreceptor drum 1Y even after the primary transfer process are removed with a discharger (not shown). Thus, a series of image forming processes is completed.

The same image forming processes as mentioned above are performed in the other image forming sections 6M, 6C and 6K except that the magenta, cyan or black developer is used, and laser light L includes information on the magenta, cyan or black image to be reproduced. Thus, magenta, cyan and black toner images are formed on the respective photoreceptor drums 1M, 1C and 1K, and then transferred onto the intermediate transfer belt 8. The yellow, magenta, cyan and black toner images are overlaid on the intermediate transfer belt 8, resulting in formation of a combined color toner image on the intermediate transfer belt 8.

Referring back to FIG. 1, the intermediate transfer unit 15 includes the intermediate transfer belt 8, the four primary transfer bias rollers 9Y, 9M, 9C and 9K, a secondary transfer backup roller 12, a cleaning backup roller 13, a tension roller 14, an intermediate transfer belt cleaner 10, etc. The intermediate transfer belt 8 is rotated by the backup roller 12 in an endless manner in a direction indicated by an arrow while supported and tightly stretched by the three rollers 12-14.

The four primary transfer bias rollers 9Y, 9M, 9C and 9K and the four photoreceptor drums 1Y, 1M, 1C and 1K sandwich the intermediate transfer belt 8 to form four primary transfer nips. In this regard, a transfer bias having a polarity opposite to that of the charge of the color toners is applied to the primary transfer bias rollers. Since the intermediate transfer belt 8, which moves in the direction indicated by the arrow, sequentially passes the primary transfer nips formed by the primary transfer bias rollers 9Y, 9M, 9C and 9K, the yellow, magenta, cyan and black toner images formed on the respective photoreceptors are transferred onto the intermediate transfer belt 8 so as to be overlaid, resulting in formation of a combined color toner image on the intermediate transfer belt 8.

When the combined color toner image formed on the intermediate transfer belt 8 is fed to a secondary transfer position, in which the intermediate transfer belt is opposed to a secondary transfer roller 19. At the secondary transfer position, the secondary transfer backup roller 12 and the secondary transfer roller 19 sandwich the intermediate transfer belt 8 to form a secondary transfer nip, and the combined color toner image on the intermediate transfer belt is transferred onto a receiving material P fed to the secondary transfer nip. In this regard, a small amount of toner particles remains on the intermediate transfer belt 8 without being transferred onto the receiving material P. When the intermediate transfer belt 8 is fed to a cleaning position, the residual toner particles are collected by the intermediate transfer belt cleaner 10. Thus, the secondary transfer process is completed.

In this regard, the receiving material P fed to the secondary transfer nip has been fed from a receiving material feeding section 26 provided on a bottom portion of the image forming apparatus 100 via a feeding roller 27 and a pair of registration rollers 28. Plural sheets of the receiving material are set on the receiving material feeding section 26. When the feeding roller 27 is rotated (counterclockwise in FIG. 1), the uppermost sheet is fed toward the pair of registration rollers 28.

The receiving material sheet P is then stopped once by the pair of registration rollers 28, and is timely fed toward the secondary transfer nip by the pair of registration rollers, which is timely rotated, so that the combined color toner image on the intermediate transfer belt 8 is transferred onto the proper position of the receiving material sheet P.

The receiving material sheet P bearing the combined color toner image thereon is then fed to a fixing device 20. The combined color toner image is heated and pressed by a fixing roller and a pressure roller to be fixed to the receiving material sheet P, resulting in formation of a fixed full color toner image on the receiving material sheet P. The receiving material sheet P is then discharged to a stacking portion 30 from the main body of the image forming apparatus by a pair of discharging rollers 29. Thus, sheets of the receiving material P each bearing an image (such as full color images (i.e., (full color) copies) are stacked on the stacking portion 30. Thus, a series of image forming processes is completed.

Next, the structure and operation of the developing device 5 of the image forming section 6 will be described in detail with reference to FIG. 2.

The developing device 5Y includes a developing roller 51Y facing the photoreceptor drum 1Y, a doctor blade 52Y facing the developing roller 51Y, developer containing portions 53Y and 54Y, feeding screws 55Y and 55Y arranged in the developer containing portions, a toner concentration detecting sensor 56Y, etc. The developing roller 51Y includes a magnet fixed therein, a sleeve rotating around the magnet, etc. The developer containing portions 53Y and 54Y contains a two-component developer G including a toner and a carrier. The developer containing portion 54Y is connected with a supplementary developer feeding pipe 43Y via an opening provided on an upper portion of the developer containing portion.

The developing device 5Y operates as follows. The sleeve of the developing roller 51Y rotates in a direction indicated by an arrow as illustrated in FIG. 2. The developer G born on the surface of the developing roller 51Y is moved thereon as the sleeve rotates due to the magnetic field formed by the magnet provided in the developing roller. In this regard, the concentration of the toner in the developer is controlled so as to fall in a predetermined range. Specifically, the toner (i.e., the supplementary developer) included in the developer container 32Y is supplied to the developer containing portion 54Y by a developer supplying device 59 (illustrated in FIG. 3) to compensate for the toner used for development with the supplied toner. The structure and operation of the developer supplying device 59 and the developer container 32Y will be described later in detail.

The toner (i.e., supplementary developer) supplied to the developer container 54Y is mixed with the developer G by the two feeding screws 55Y and 55Y while circulated in the two developer containers 53Y and 54Y (in a direction perpendicular to the paper sheet on which FIG. 2 is illustrated). The toner in the developer G is charged due to friction between the toner and the carrier therein, and thereby the toner is adhered to the surface of the carrier. Therefore, the toner is born on the surface of the developing roller 51Y together with the carrier due to the magnetic force of the developing roller.

The developer G thus born on the developing roller 51Y is fed in the right direction in FIG. 2 and reaches the doctor blade 52Y. The doctor blade 52Y scrapes the developer G born on the developing roller 51Y to form a developer layer, which has a thickness in a proper range, on the developing roller. The developer layer is then fed to the development region in which the developing roller 51Y is opposed to the photoreceptor drum 1Y. The toner in the developer layer is adhered to an electrostatic latent image formed on the surface of the photoreceptor drum 1Y due to an electric field formed on the development region. The developer G remaining on the surface of the developing roller 51Y is then fed toward an upper portion of the developer containing portion 53Y as the sleeve of the developing roller rotates, followed by releasing from the developing roller at the position.

Next, the developer supplying device 59, which feeds the supplementary developer contained in the developer container 32Y to the developing device 5Y, will be described in detail with reference to FIG. 3. In order that the structure of the developer supplying device 59 can be easily understood, the developer container 32Y, and the developer feeding passage (i.e., combination of parts 34Y, 60, 70 and 71) are illustrated while the angle thereof is changed. In reality, they are arranged in a direction perpendicular to the paper sheet on which FIG. 3 is illustrated, as can be understood from FIG. 1.

As illustrated in FIGS. 4 and 7, the developer containers 32Y, 32M, 32C and 32K are set in the developer container containing portion 31 of the image forming apparatus 100. The supplementary developers contained in the developer containers 32Y, 32M, 32C and 32K are supplied to the respective developing devices 5Y, 5M, 5C and 5K through the respective supplementary developer feeding passages. The structures of the supplementary developer feeding passages are substantially the same except that the color of the toner included in the supplementary developer is different.

Specifically, as illustrated in FIG. 3, when the developer container 32Y is set in the developer container containing portion 31, a hold portion 34Y of the developer container 32Y is connected with a nozzle 70 of the developer container containing portion 31. In this case, a switching member 34*d* of the developer container 32Y is sandwiched by the nozzle 70 and a pick 76, which is biased by a blade spring 77, and opens a developer exit of the hold portion 34Y. Therefore, the supplementary developer contained in a main body 33Y of the developer container 32Y is fed to the nozzle 70 through the developer exit.

The other end of the nozzle 70 is connected with one end of a tube 71 serving as a feeding tube. The tube 71 is made of a flexible material having a good toner resistance. The other end of the tube 71 is connected with a screw pump 60 (i.e., MOHNO pump) of the developer supplying device 59. The tube 71 has an inner diameter of from 4 mm to 10 mm.

Suitable materials for use as the tube include rubbers such as polyurethane, nitrile rubbers, EPDMs and silicone rubbers, and resins such as polyethylene resins, and nylon resins. By using such a flexible tube as the tube 71, the flexibility in layout design of the supplementary developer feeding passage can be enhanced, resulting in miniaturization of the image forming apparatus.

The screw pump 60 is a suction type single axis eccentric screw pump, and has a rotor 61, a stator 62, a suction opening 63, a universal joint 64, a motor 66, etc. The rotor 61, stator 62, and universal joint 64 are contained in a case (not shown). The stator 62 is an internal thread made of an elastic material such as rubbers, and a spiral groove having a double pitch is formed on the inner surface of the stator. The rotor 61 is a screw, which is made of a rigid material such as metals and which has a spiral groove on the outer surface. The rotor 61 is rotatably engaged with the stator 62. One end of the rotor 61 is rotatably connected with the motor 66 via the universal joint 64.

In the screw pump 60, the rotor 61 located in the stator 62 is driven by the motor 66 to rotate in a direction indicated by an arrow (in FIG. 3) (i.e., rotate counterclockwise when observed from the upstream side relative to the developer feeding direction), thereby forming a sucking force in the suction opening 63. Namely, the air in the tube 71 is discharged, resulting in generation of a negative pressure in the tube. Therefore, the supplementary developer in the developer container 32Y is sucked through the tube 71 so as to be fed toward the suction opening 63. The supplementary developer fed to the suction opening 63 is fed to a gap between the stator 62 and the rotor 61, and is then fed toward the other end of the screw pump 60 due to rotation of the rotor 61. Thus, the supplementary developer is discharged from an exit 67 of the screw pump 60, thereby supplying the supplementary developer to the developing device 5Y through a developer feeding pipe 43Y. The developer moving route is illustrated by an arrow with a dotted line in FIG. 3.

Next, the developer container will be described with reference to FIGS. 5 and 6. As mentioned above with reference to FIGS. 1-4, the four cylindrical supplementary developer containers 32Y, 32M, 32C and 32K are detachably attached to the developer container containing portion 31 (see also FIG. 7). When the developer container 32 ends the life (i.e., the supplementary developer therein is substantially exhausted), the container is replaced with a new container. The color developers contained in the developer containers 32Y, 32M, 32C and 32K are timely supplied to the respective image forming sections 6Y, 6M, 6C and 6K through the developer supplying passage described above with reference to FIG. 3.

Figure 5:
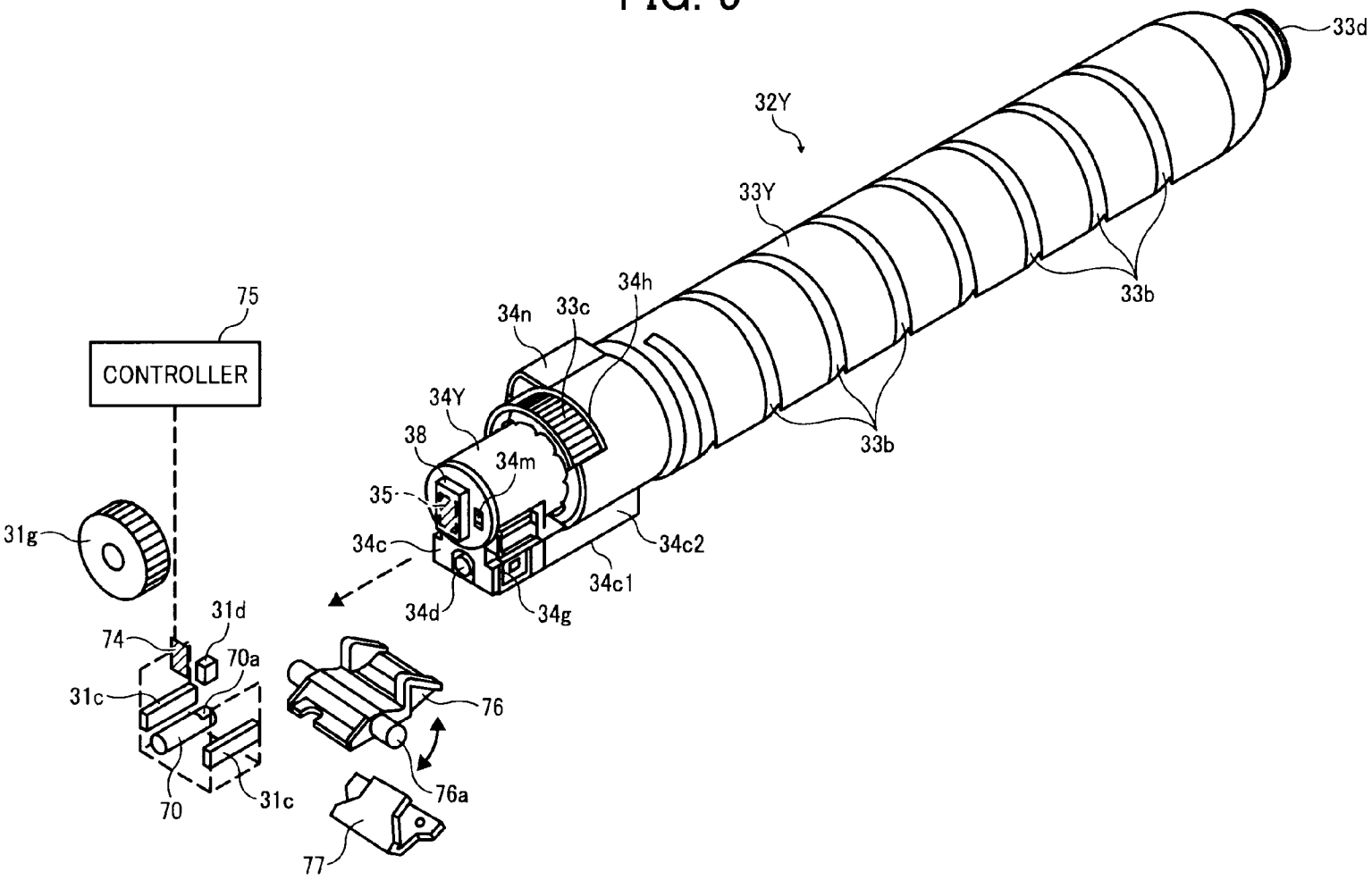
FIG. 5 is a schematic perspective view illustrating a supplementary developer container of the image forming apparatus.
Figure 6:
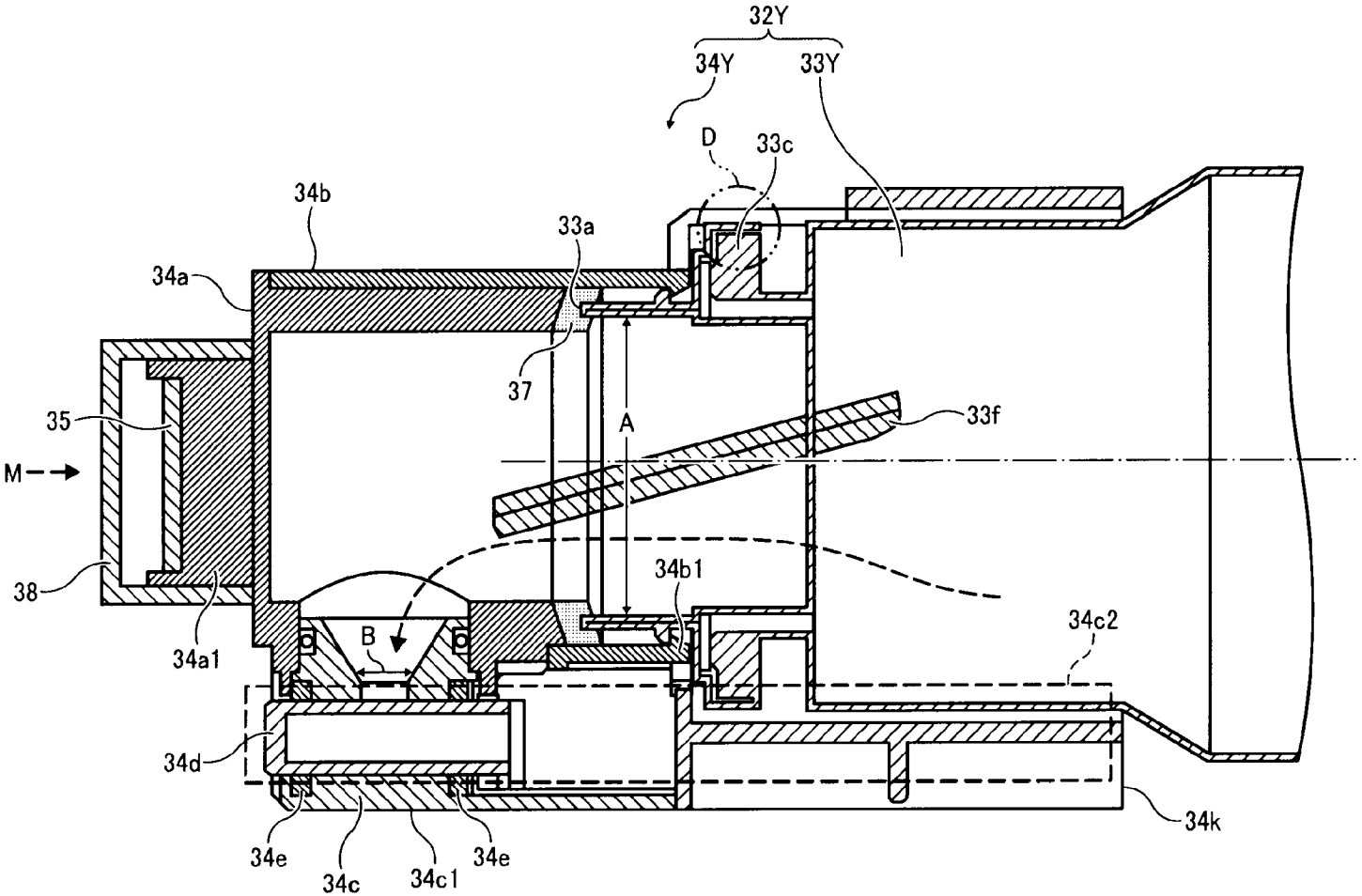
FIG. 6 is a cross-sectional view illustrating the head portion of the supplementary developer container.

FIG. 5 is a perspective view illustrating the developer container 32Y, and FIG. 6 is a cross-sectional view illustrating the head portion of the developer container 32Y. The other developer containers 32M, 32C and 32K have the same structure as the developer container 32Y except that the color of the toner included in the container and the positions of a recessed portion 34*m* and a projected portion 34*n* are different. Therefore, the yellow developer container 32Y is mainly described hereinafter while properly omitting description of the other developer containers 32M, 32C and 32K.

As illustrated in FIG. 5, the developer container 32Y includes the main body 33Y and the hold portion 34Y (i.e., bottle cap) provided at the head portion as main parts. A gear 33*c* integrally rotating with the main body 33Y, and an opening A are provided on the head portion of the main body (see FIG. 6). The opening A is provided on the head portion of the main body 33Y (i.e., the leading end of the container when the container is attached to the image forming apparatus) so that the supplementary developer contained in the main body 33Y is discharged toward the space (cavity) in the hold portion 34Y.

The gear 33*c* is engaged with a driving gear 31*g* provided on the developer container containing portion 31 of the main body 100 to rotate the main body 33Y on a rotation axis (illustrated by a dashed line in FIG. 6). Specifically, the gear 33*c* is projected from a notch 34*h* of the hold portion 34Y to be engaged with the driving gear 31*g* of the main body 100 at the engaging position D illustrated in FIG. 6. The driving gear 31*g* transmits a driving force to the gear 33*c*, thereby rotating the main body 33Y of the container. In this first example, each of the driving gear 31*g* and the gear 33*c* is a spur gear.

Referring to FIG. 5, a grip portion 33*d* is provided on the rear end of the main body 33Y so that a user can easily perform a detaching/attaching operation using the grip portion. In addition, a spirally projected portion 33*b* is provided on the inner surface of the main body 33Y. When the main body is observed from outside, the spirally projected portion 33*b* has a form of a spiral groove. The spirally projected portion 33*b* is provided to discharge the developer from the opening A when the main body 33Y is rotated in the predetermined direction. The main body 33Y is prepared by a blow molding method together with the gear provided thereon.

In this example, the developer container 32Y has an agitating member 33*f* which is provided at the opening A and which is rotated together with the main body 33Y. The agitating member 33*f* is a bar-form member extending from the space in the hold portion 34Y to the space in the main body 33Y while being slanted relative to the rotating axis illustrated by the dashed line in FIG. 6. Since the agitating member 33*f* rotates together with the main body 33Y, the developer in the container can be well discharged from the opening A.

In this example, the main body 33Y of the developer container 32Y is rotated (counterclockwise when observed from the upstream side relative to the toner feeding direction), and the spiral direction (winding direction) of the projected portion 33*b* of the main body 33Y is set to the right direction. Therefore, when the main body 33Y rotates, clockwise vortex airflow is formed in the developer container 32Y. In this regard, the rotating direction of the vortex airflow is the same as that of the vortex airflow formed in the screw pump 60.

Referring to FIGS. 5 and 6, the hold portion 34Y is constituted of a cap 34*a*, a cap cover 34*b*, a holder 34*c*, a shutter 34*d*, a packing 34*e*, an IC chip 35 serving as an electronic component, etc. In addition, an engaging portion 34*g* (groove portion) is provided on both side surfaces of the hold portion 34Y so as to be engaged with a positioning member 31*c* of the developer container containing portion 31. Further, the recessed portion 34*m* is provided on an edge of the hold portion 34Y to be engaged with an engaging member 31*d* of the developer container containing portion 31. Furthermore, the projected portion 34*n* is provided on a peripheral surface of the hold portion 34Y so as to be engaged with another engaging member (not shown) of the developer container containing portion 31. Furthermore, the notch 34*h*, which reveals a part of the gear 33*c*, is provided on an upper portion of the hold portion 34Y.

Since the hold portion 34Y is connected with the main body 33Y through the opening A, the supplementary developer discharged from the opening A is discharged from a discharge opening B, i.e., the supplementary developer moves as illustrated by a dotted line in FIG. 6. In this regard, the space formed in the hold portion 34Y has a cylindrical form, and the developer discharge passage (vertical passage) formed between the cylindrical space and the discharge opening B has a cone form as illustrated in FIG. 6. Thereby, the vortex airflow formed in the rotated main body 33Y by rotation of the main body can be maintained in the cone form developer discharge passage. Therefore, the supplementary developer can be efficiently fed through the discharge opening B and the tube 71.

The hold portion 34Y is not rotated with the main body 33Y, and is engaged with the positioning member 31*c* of the engaging portion 34*g* so as to be held by a holding portion 73 (illustrated in FIG. 4) of the toner container containing portion 31. The cap cover 34*b* of the hold portion 34Y is adhered to the peripheral surface of the cap 34*a*. A pick 34*b*1 is provided on the tip of the cap cover 34*b*. Since the pick 34*b*1 is engaged with an engaging member formed on the head portion of the main body 33Y, the main body 33Y is rotatably supported relative to the hold portion 34Y. In order to smoothly rotate the main body 33Y, the pick 34*b*1 of the hold portion 34Y is engaged with the engaging member of the main body 33Y with a proper clearance therebetween.

In addition, a seal member 37 is adhered to a surface of the hold portion 34Y, which faces a front edge surface 33*a* in the vicinity of the opening A. The seal member 37 is provided to seal the gap between the surface of the main body 33Y and the surface of the hold portion 34Y, and is made of an elastic material such as foamed polyurethane. Further, the holder 34*c* is provide below the hold portion 34Y, and the shutter 34*d*, which serves as a switching member for switching the discharge opening B in conjunction with the operation of attaching/detaching the developer container 32Y, is provided on the holder.

Specifically, the shutter 34*d* is provided in the holder 34*c* so as to be movable in the right and left directions in FIG. 6 while surrounded by sliders 34*c*1 and 34*c*2. A space (recessed portion) is formed on the bottom surface of the holder 34*c* so that the pick 76 is engaged with the shutter member 34*d*, and the shutter is moved. In addition, the packing 34*e* (such as G seals) is provided on both ends to prevent leakage of the supplementary developer from the vicinity of the shutter member 34*d*. Further, a packing (such as O rings) is proved at the engaging portion of the holder 34*c* and the cap 34*a* to prevent leakage of the developer therefrom. In this regard, when the developer container 32Y is set on the developer container containing portion 31, the pick 76 (illustrated in FIG. 5), which serves as a biasing member for biasing the shutter member 34*d* to close the discharge opening B, is engaged with the right end of the shutter 34*d*. The pick 76 serves as a biasing member by receiving a biasing force from a blade spring 77 (second biasing member).

The IC chip 35 is provided on the hold portion 34Y such that when the developer container 32Y is attached to the developer container containing portion 31, the IC chip takes such a position as to be opposed to a communication circuit 74 of the developer container containing portion 31 while being apart therefrom by a predetermined distance. Specifically, the IC chip 35, which is an electronic component, is provided on a projected portion 34*a*1 of the hold portion 34Y extending in a direction indicated by an arrow in FIG. 5 (i.e., in the container attaching direction). The IC chip 35 is arranged on a surface of the projected portion 34*a*1 so as to be perpendicular to the container attaching direction. In addition, the IC chip 35 makes non-contact communication (i.e., wireless communication) with the communication circuit 74 when the hold portion 34Y is held by the developer container containing portion 31.

The IC chip 35 stores various pieces of information concerning the developer container 32Y and the supplementary developer contained therein. The communication circuit 74 of the developer container containing portion 31 wirelessly sends and receives such information to/from the IC chip 35 when the developer container 32Y is set to the developer container containing portion 31. Specifically, the information stored in the IC chip 35 is sent to a controller 75 (illustrated in FIG. 5) of the main body 100 of the image forming apparatus via the communication circuit 74, or information concerning the main body 100 obtained by the controller 75 is sent to the IC chip 35 to be stored therein.

Specific examples of the information stored in the IC chip include information concerning the toner such as color, serial number, and manufacturing date of the toner contained in the developer container 32Y; information concerning the developer container 32Y such as the number of recycling operations that the container is subjected, date of the recycling operations, and name of company performing the recycling operations. When the developer container 32Y is set to the developer container containing portion 31, the information stored in the IC chip 35 is sent to the controller 75 via the communication circuit 74. The controller 75 optimally controls the main body 100 of the image forming apparatus according to the information. For example, in case the developer container is mistakenly set to a wrong position (i.e., a different color developer container setting position), the controller prohibits the operation of the developer supplying device. In addition, the controller 75 may change the image forming conditions depending on the information such as serial number of the toner used, and the recycling company.

In this example, a protective cap 38 for covering the IC chip 35 is provided on the hold portion 34Y. Specifically, the protective cap 38 covers the entire of the surface of the IC chip 35, which surface faces the communication circuit 74. The protective cap 38 is made of a resin having a relatively high mechanical strength, and is thin so as not to interfere in communication between the IC chip 35 and the communication circuit 74. Such a protective cap 38 prevents occurrence of a problem in that the IC chip 35 is damaged when the developer container 32Y mistakenly hits against the main body 100 or the like in a developer container replacement operation while maintaining the communication function of the IC chip.

In addition, the sliding portions 34*c*1 and 34*c*2, which slide on the developer container containing portion 31 in conjunction with the container attaching/detaching operation, are provided on the holder 34*c* of the hold portion 34Y. Specifically, the first sliding portion 34*c*1 is a plane parallel to the sliding surface of the developer container containing portion 31, and is provided on the bottom portion of the hold portion 34Y, which is attached to or detached from the developer container containing portion. In addition, the second sliding portion 34*c*2 is a plane parallel to the sliding side surface of the developer container containing portion 31, and is provided on the side portion of the hold portion 34Y.

Referring to FIG. 5, the recessed portion 34*m* to be engaged with the engaging portion 31*d* of the developer container containing portion 31 is provided on the end surface of the hold portion 34Y in the vicinity of the projected portion 34*a*1. The recessed portion 34*m* is engaged with the engaging member 31*d* when the developer container is set to the proper position of the developer container containing portion 31. Therefore, occurrence of a problem in that a color developer container is set to a wrong position of the developer container containing portion 31 (for example, a case where a yellow developer container is set to the position of a cyan developer container) can be prevented.

Referring to FIG. 5, the projected portion 34*n* to be engaged with another engaging member (not shown) is provided on the peripheral surface of the hold portion 34Y. Similarly to the recessed portion 34*m*, the projected portion 34*n* is engaged with the engaging member when the developer container is set to the proper position of the developer container containing portion 31. Although it is not shown, the projected portion 34*n* is provided at a position of the hold potion 34Y, wherein the position is different depending on the color of the toner contained in the developer container. Therefore, occurrence of the problem in that a color developer container is set to a wrong position of the developer container containing portion 31 can be prevented.

Each of the toners contained in the developer container 32Y, 32M, 32C and 32K preferably satisfies the following relationships:

$$3\ \mu m \leqq Dv \leqq 8\ \mu m, \text{ and}$$

$$1.0 \leqq Dv/Dn \leqq 1,$$

wherein Dv and Dn represent the volume average particle diameter (in units of μm) of the toner, and the number average particle diameter (in units of μm) of the toner, respectively.

By using such toners, color images having good image qualities can be produced over a long period of time. In addition, even when the developer including the toner is agitated in the developing device over a long period of time, the developer can maintain good developing property. Further, occurrence of a problem in that the developer supplying passage such as tube 71 is clogged with the toner can be prevented, and therefore the toner (i.e., the supplementary developer including the toner and a carrier) can be securely fed efficiently. The volume average particle diameter and number average particle diameter of toner can be measured with an instrument such as COULTER COUNTER TA-2 and COULTER MULTISIZER 2, which are manufactured by Beckman Coulter Inc.

In addition, it is preferable for each of the toners contained in the developer container 32Y, 32M, 32C and 32K that the toner has substantially spherical form, and has a first shape factor SF-1 of from 100 to 180, and a second shape factor SF-2 of from 100 to 180. In this case, the toner has a good transfer efficiency without deteriorating the cleaning property thereof. In addition, occurrence of the problem in that the developer supplying passage such as tube 71 is clogged with the toner can be prevented, and the toner can be securely fed efficiently.

The first shape factor SF-1 represents sphericity of toner particles and is represented by the following equation:

$$SF\text{-}1=(M^2/S)\times(100\pi/4),$$

wherein M represents the maximum diameter of a projected image of a toner particle, and S is the area of the projected image of the toner particle. In this regard, a toner having a SF-1 of 100 is spherical. As the SF-1 increases (from 100), the spherical degree of the toner decreases.

The second shape factor SF-2 represents asperity of toner particles and is represented by the following equation:

$$SF\text{-}2=(N^2/S)\times(100/4\pi),$$

wherein N represents the circumferential length of a projected image of a toner particle, and S is the area of the projected image of the toner particle. In this regard, a toner having a SF-2 of 100 is spherical without projected or recessed portions on the surface thereof. As the SF-2 increases (from 100), the toner particle have larger projected or recessed portions on the surface thereof. The shape factors SF-1 and SF-2 of toner particles can be determined by analyzing a microphotograph of the toner particles, which is taken by a scanning electron microscope such as S-800 from Hitachi Ltd., using an image analyzer LUZEX 3 from Nireco Corp.

Next, the operation of attaching/detaching the developer container to/from the developer container containing portion 31 will be briefly described. Referring to FIG. 7, in order to attach the developer container 32Y to the developer container containing portion 31 of the main body 100, a cover 110 of the main body 100 is opened so that the developer container containing portion 31 is exposed. A new container of the developer container 32Y is pressed into the developer container containing portion 31 along the longitudinal direction thereof in such a manner that the hold portion 34Y firstly enters into the developer container containing portion. Thus, the new container is attached to the developer container containing portion.

In this case, the first sliding portion 34*c*1 of the head portion of the developer container 32Y is slid on the sliding surface of the developer container containing portion 31. Therefore, an operator can easily press the developer container 32Y while holding the grip portion 33*d* located at the rear end of the developer container 32Y. When the holder 34*c* of the developer container 32Y reaches the holding portion 73 of the developer container containing portion 31, not only the first sliding portion 34*c*1 slides on the sliding surface but also the second sliding portion 34*c*2 slides on the sliding side surface, and thereby the hold portion 34Y is positioned. Specifically, the engaging portion 34*g* of the hold portion 34Y starts to be engaged with the positioning member 31*c* of the developer container containing portion 31. In this regard, the hold portion 34Y of the developer container 32Y is biased toward the holding portion 73 by a pair of arms (not shown). In addition, the pick 76 provided on the holding portion 73 is evacuated to a position at which the pick does not interfere in attachment of the hold portion 34Y. Specifically, the pick 76 is evacuated by being rotated on a rotation axis 76*a* in a direction indicated by an arrow illustrated in FIG. 5. Namely, the pick 76 is pressed down by the sliding portion 34*c*1 in such a direction as to be opposed to the biasing force of the blade spring 77.

When the developer container attaching operation further proceeds, the developer discharging opening B starts to be opened by the shutter 34*d* while the engaging portion 34*g* is engaged with the positioning member 31*c*. Namely, as the tip of the nozzle 70 is inserted into the hole of the holder 34*c*, the shutter 34*d* is pressed by the nozzle 70. In this case, the pick 76 is changed from the evacuation position to an engaging position at which the pick is engaged with the shutter 34*d* (i.e., the pick is rotated on a rotation shaft 76*a*). Namely, the pick 76 is pressed upward by the biasing force of the blade spring 77 while released from pressing of the sliding portion 34*c*1, thereby achieving the default position thereof.

In this regard, since the shutter 34*d* is sandwiched by the nozzle 70 and the pick 76, the shutter takes a fixed position at the developer container containing portion 31. When the developer container 32Y is further moved in the attaching direction, the developer discharge opening B is opened while the shutter 34*d* takes the fixed position (i.e., the shutter 34*d* is relatively moved).

When the holder 34*c* is struck to the striking position of the holding portion 73, the position of the hold portion 34Y is fixed, and in addition the shutter 34*d* completely opens the discharge opening B while the gear 33*c* of the developer container 32Y is engaged with the driving gear 31*g* of the driving portion of the developer container containing portion 31. In addition, since the IC chip 35 takes such a position as to be opposed to the communication circuit 74, the IC chip can wirelessly communicate with the communication circuit. Further, the recessed portion 34*m* and the projected portion 34*n* are engaged with the corresponding engaging members of the main body 100 to ensure the non-compatibility of the developer container. In this case, the developer discharge opening B is connected with a developer supplying opening 70*a* of the nozzle 70, resulting in completion of the developer container attaching operation.

In contrast, when the developer container 32Y is detached from the developer container containing portion 31, the procedure of the attaching operation is reversed. Specifically, in conjunction with the detaching operation of the developer container 32Y from the holding portion 73, the shutter 34*d* is biased by the pick 76 while the position of the shutter in the holding portion 73 is fixed by the nozzle 70 and the pick 76, thereby closing the developer discharge opening B. In this case, the end of the shutter 34*d* is engaged with the engaging portion of the hold potion 34Y, resulting in completion of the closing operation of the developer discharge opening B. When the developer container 32Y is further moved in the releasing direction, the pick 76 is moved to a position at which the pick does not interfere in releasing of the hold portion 34Y. After the hold portion 34Y is completely released from the developer container containing portion 31, the pick 76 is released from pressing of the first sliding portion 34*c*1, and returns to the default position by the biasing force of the blade spring 77.

As mentioned above, in the image forming apparatus, the developer container attaching and detaching operations can be completed only by one action (except for the opening/closing operation of the cover 110) in which the sliding portion 34*c*1 slides on the sliding surface 31*a*. The developer container 32Y is set such that the developer discharge opening B faces downward while taking a lower position than the opening A, and after the shutter 34*d* is certainly positioned in conjunction with the attaching operation, the discharge opening B, which is sealed with the packing 34*e*, is opened by being pressed by the nozzle 70. Therefore, the discharge opening B is hardly contaminated with the developer, and occurrence of a problem in that hands of an operator are contaminated with the developer can be prevented.

In addition, since the developer container attaching and detaching operations can be completed only by one action, the operability and workability in the developer container replacement operation can be enhanced. In particular, since the first sliding portion 34*c*1 is provided on the bottom portion of the hold portion 34Y, the sliding portion can slide on the sliding surface 31*a* while supporting the developer container 32Y. Further, in the developer container attaching operation, sliding of the first sliding portion 34*c*1 is started while the grip portion 33*d* of the developer container is directly gripped by an operator, and positioning of the hold portion 34Y is then started by biasing of the pair of arms. Next, the insertion of the nozzle 70 is started. When the sliding operation is completed, positioning of the hold portion 34Y, insertion of the nozzle 70, and connection of the driving portions are completed. Therefore, as the sliding operation of the hold portion 34Y proceeds, the operator feels by a click that the hold portion is positioned and decides that the attaching operation is securely performed without errors.

Since the developer container 32Y is set to the developer container containing portion 31 from the front side of the developer container containing portion instead of the upper side thereof, the flexibility in layout design of the portion of the image forming apparatus above the developer container containing portion can be enhanced. For example, even in a case where a scanner (i.e., document reading portion) is arranged above the developer supplying device, the operability and workability of the developer container attaching operation is not deteriorated. In addition, the flexibility in layout design of the engaging position D of the gear 33*c* of the developer container 32Y with the driving gear 31*g* of the main body 100 can also be enhanced. In addition, since the developer container 32Y is set so as to extend horizontally, the height of the image forming apparatus can be reduced while increasing the volume of the developer contained in the developer container. Therefore, the frequency of the developer container replacement operation can be decreased.

The above-mentioned developer container 32 includes a supplementary developer for a two component developer, which includes a toner and a carrier in a predetermined weight ratio. In addition, in the above-mentioned example, the projected portion 33*b* is integrally formed on the inner surface of the main body 33Y of the container and the main body is rotated. However, it is possible to rotate a coil or a screw set in the main body 33Y of the developer container without rotating the main body. Even in such a case, the protective cap 38 can be provided to cover the IC chip 35, and opening/closing of the discharge opening B by the shutter 34*d* can be performed in conjunction with the attaching/detaching operation (i.e., one action) of the developer container 32.

The above-mentioned developer supplying device uses a suction type screw pump (screw pump 60) to suck air in the tube 71. However, a discharge type screw pump, which feeds air into the tube 71 can also be used therefor. In addition, a diaphragm type air pump can be used as a pump to be connected with the tube 71.

A process cartridge can be used for part or the entire of each of the image forming section 6. In addition, the developer container 32 can be integrated into the process cartridge. Namely, the developer container can be used as one component of such a process cartridge.

Next, the developer supplying device of an embodiment of the present invention will be described. The developer supplying device of the present invention relates to a developer supplying device, which is used for image forming apparatus using a two-component developing method and which supplies a supplementary developer including a toner and a carrier to image forming apparatus.

Figure 8:
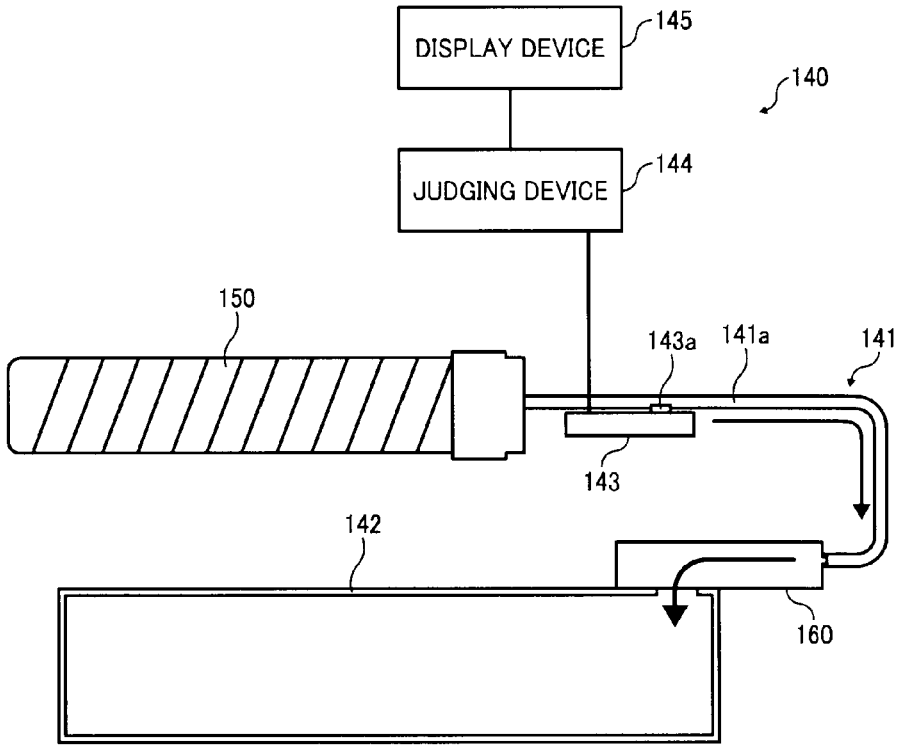
FIG. 8 is a schematic view illustrating an example of the developer supplying device of the present invention.
Figure 9:
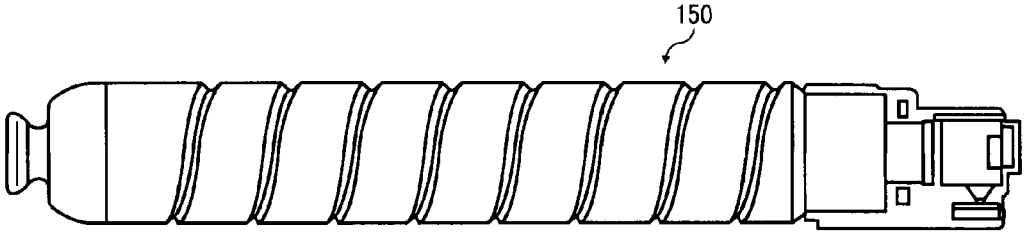
FIG. 9 is a schematic view illustrating a supplementary developer container for use in the developer supplying device.

FIG. 8 is a schematic view illustrating an example of the developer supplying device of the present invention. FIG. 9 is a plan view illustrating a developer container (hereinafter referred to as developer bottle) of the developer supplying device. Referring to FIG. 8, a developer supplying device 140 includes a developer bottle 150, which is replaceable and which contains a supplementary developer including a toner and a carrier in a predetermined ratio; a developer feeding tube 141 serving as a supplementary developer feeding passage; and a MOHNO pump 160 serving as a feed pump. The developer supplying device 140 feeds the supplementary developer to a developing device 142.

In addition, a sensor 143, which detects the content of the carrier in the supplementary developer, is provided on a horizontally-extending portion 141*a* of the developer feeding tube 141. The sensor 143 is a non-contact sensor measuring the permeability of the fed supplementary developer, and has a sensing head 143*a*. Further, the sensor 143 includes a judging device 144 which estimates the amount of the supplementary developer contained in the developer bottle 150 and determines the end and near-end of the developer in the developer bottle, and a display 145 which notifies a user of the end or near-end of the developer. As mentioned above, the developer end or developer near-end notification is to notify a user that the developer in the developer bottle is exhausted or substantially exhausted, and is instructions for replacing the developer bottle.

The judging device 144 is a computer including, for example, a CPU, a RAM, a ROM, etc., and executes predetermined software to carry out the above-mentioned function. For example, a CPU of the judging device 144 compares the data output from the sensor 143 with threshold data in a table stored in a ROM to determine whether the developer is in an end state or a near-end state. The display 145 indicates "developer end" or "developer near-end" in a displaying device provided in the vicinity of an operation panel of the image forming apparatus. In this regard, a voice output device notifying a user of "developer end" or "developer near-end" can be used instead of such a display. A RAM includes a storage space storing the state of flag in a controlling processing mentioned below.

The developer bottle 150 has a structure similar to that of the developer container 32. It is preferable to use a pump generating a pressure difference to feed the supplementary developer in the developer bottle 150 to the developing device 142. In this example, a silicone tube is used for the developer feeding tube 141. Therefore, such a developer feeding tube can be arranged relatively freely compared to a case where a screw is used for feeding the supplementary developer. Namely, the flexibility in layout design can be enhanced, and thereby the image forming apparatus can be miniaturized. In addition, when a screw is used for the developer feeding passage, great stress is applied to the supplementary developer if the developer feeding passage is long, resulting in deterioration of the supplementary developer. In contrast, when a pump is used for the developer feeding passage, the stress applied to the supplementary developer can be reduced even when the developer feeding passage is long. In addition, when a tube is used for the developer feeding passage, the horizontally-extending portion 141*a* can be easily formed.

Figure 10:
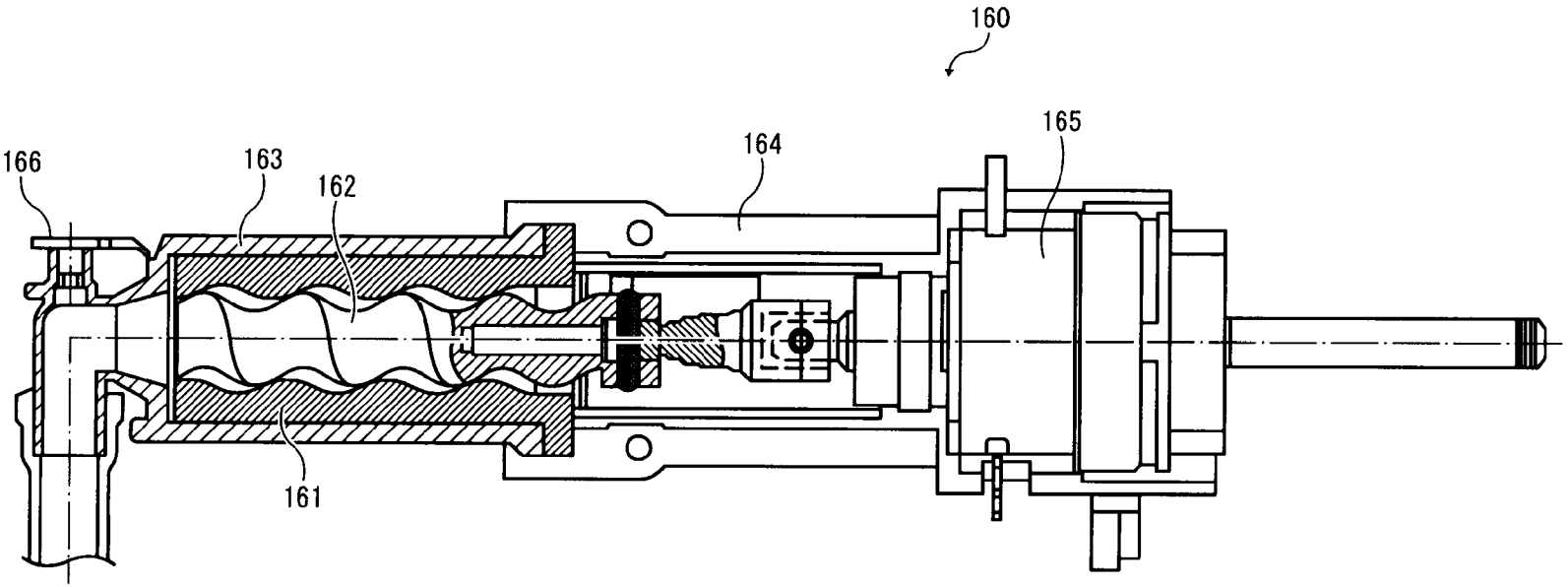
FIG. 10 is a schematic cross-sectional view illustrating a MOHNO pump (one-rotor screw pump) for use in the developer supplying device of the present invention.

As mentioned above, a MOHNO pump is used as the developer feeding pump. FIG. 10 is a cross-sectional view illustrating a MOHNO pump 160. The MOHNO pump 160 is a single-axis eccentric screw pump including a cylindrical case 161, and a rotor 162 having one spiral projected portion, and a cylindrical stator 163 having two spiral grooves on the inner surface thereof, which are provided in the cylindrical case 161. In addition, the MOHNO pump 160 includes a supply case 164, a supply clutch 165, and a tube cleaning cap 166. Since the MOHNO pump can severely control the developer feeding amount, the minimum developer feeding time can be shortened. Namely, the amount of the fed developer can be precisely controlled thereby.

Further, the MOHNO pump 160 has a property such that when no developer is supplied to the pump and the pump makes idle running, the performance of the pump seriously deteriorates. Therefore, when it is judged that no developer remains in the developer bottle 150, it is necessary to rapidly stop the MOHNO pump. Since the developer-end can be precisely determined by detecting the carrier concentration in this example, occurrence of the problem in that the performance of the pump seriously deteriorates due to idle running of the pump can be prevented.

Figure 12:
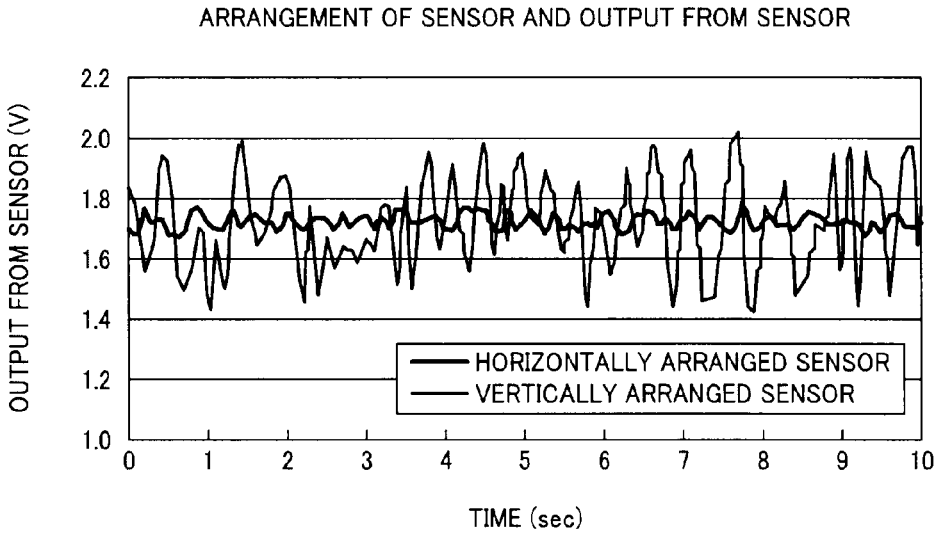
FIG. 12 is a graph showing variation of the output (carrier concentration) from a sensor when the arrangement direction of the sensor is changed.

Non-contact type sensors measuring the permeability of a developer can be used for the sensor 143. Carrier typically includes a particulate ferrite having magnetism, whose surface is covered with a resin having a charge imparting property. Therefore, the carrier concentration in a developer including a toner and a carrier can be determined by measuring the permeability of the developer. In addition, non-contact type permeability measuring devices have been commercialized. Therefore, by using such a non-contact type permeability measuring device, the amount of residual developer can be precisely determined, and thereby the developer end and developer near-end can be precisely determined without modifying the developer feeding passage (such as formation of hole on the developer feeding passage). Further, when the sensor 143 is provided on the horizontally-extending portion of the developer feeding tube 141 as illustrated in FIG. 8, the sensor output can be stabilized (as illustrated in FIG. 12), and thereby the amount of the residual developer can be precisely determined, resulting in precise judgment of the developer end and developer near-end.

The present inventor made an experiment to determine the relation between the amount of carrier remaining in a developer bottle and the concentration of the carrier in the developer fed from the developer bottle. In the experiment, a supplementary developer including 1840 g of a toner and 160 g of a carrier (carrier concentration of 8%) was contained in the developer bottle. In this regard, at first, the carrier was fed into the developer bottle, and then the toner was fed into the developer bottle. The experiment was performed on four supplementary developers, i.e., yellow, magenta, cyan and black supplementary developers.

FIG. 11 is a graph showing the relation between the amount of the supplementary developer remaining in the developer bottle and the concentration of the carrier in the supplementary developer fed from the developer bottle. Since the carrier has much larger specific gravity than the toner, the carrier is not easily discharged from the developer bottle. It can be understood from FIG. 11 that when the amount of residual supplementary developer is large (not less than about 1,000 g), the concentration of the carrier in the fed supplementary developer is low, i.e., the carrier is hardly discharged from the developer bottle. When the amount of residual supplementary developer decreases so as to be less than about 1,000 g, the carrier concentration increases. However, when the amount of residual supplementary developer is less than about 300 g, the concentration of the carrier in the fed supplementary developer decreases again. It was confirmed by the experiment that this characteristic is common to the four color supplementary developers, and the carrier concentration curves have high reproducibility.

It can be understood from the experimental results that by measuring the concentration of the carrier in the supplementary developer fed through the developer feeding tube 141 of the developer supplying device 140, the amount of the supplementary developer remaining in the developer bottle 150 can be estimated. In addition, when the carrier concentration increases and then decreases so as to be lower than a predetermined value (10% in this example), it is determined that the developer is in a "near-end" or "end" state. Thus, the developer end or near-end detection can be easily performed.

Since the carrier concentration rapidly decreases at the "near-end" or "end" state, the developer end or near-end detection may be performed on the basis of the variation (e.g., decreasing rate) of the carrier concentration.

FIG. 12 is a graph showing the relation between the arrangement of the sensor and output from the sensor. It can be understood from FIG. 12 that the output from the sensor 143, which is horizontally arranged, is different from the output from the sensor, which is vertically arranged, and variation in output is smaller when the sensor is horizontally arranged. In this experiment, the concentration of carrier in the supplementary developer is 8%, and the output from the sensor is about 1.72V. In addition, the sensor output is sampled at intervals of 100 ms.

It is clear from FIG. 12 that the sensor should be horizontally arranged because the output from the sensor is stable. Thus, by horizontally arranging the sensor, estimation of the amount of residual supplementary developer in a developer bottle, and determination of end and near-end of developer can be precisely performed.

Figure 13:
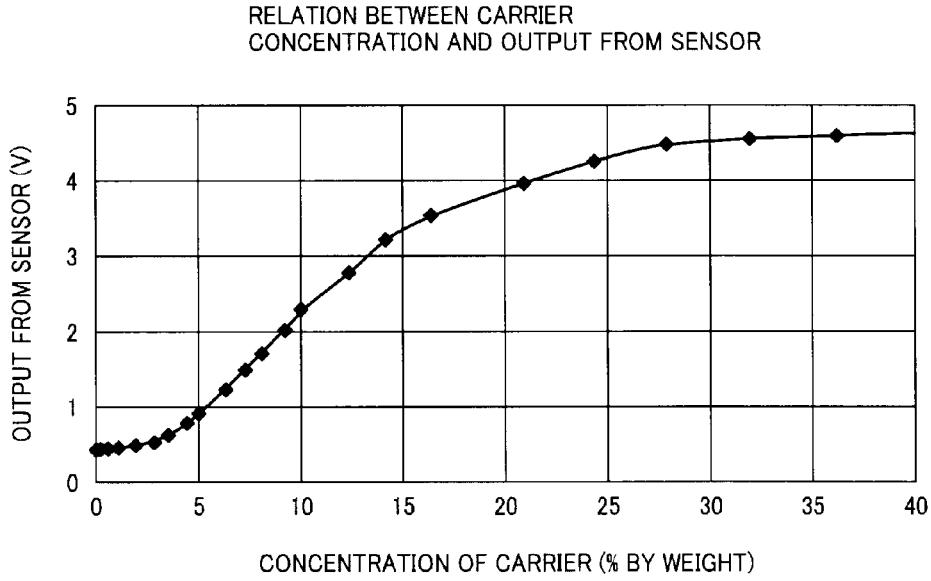
FIG. 13 is a graph showing the relation between the carrier concentration of carrier in a developer and the output from a sensor measuring the carrier concentration.
Figure 14:
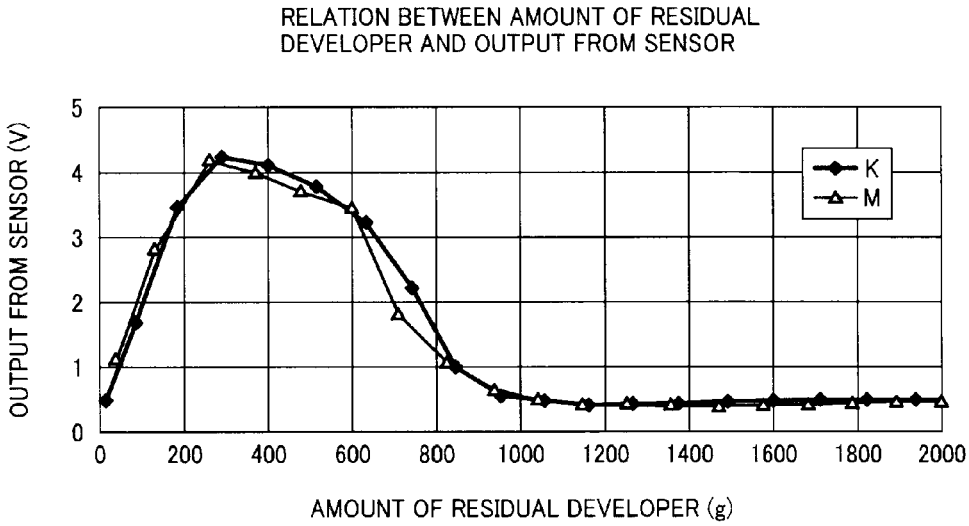
FIG. 14 is a graph showing the relation between the amount of residual black and magenta developers and the outputs from a sensor measuring the carrier concentration in the fed developer.
Figure 15:
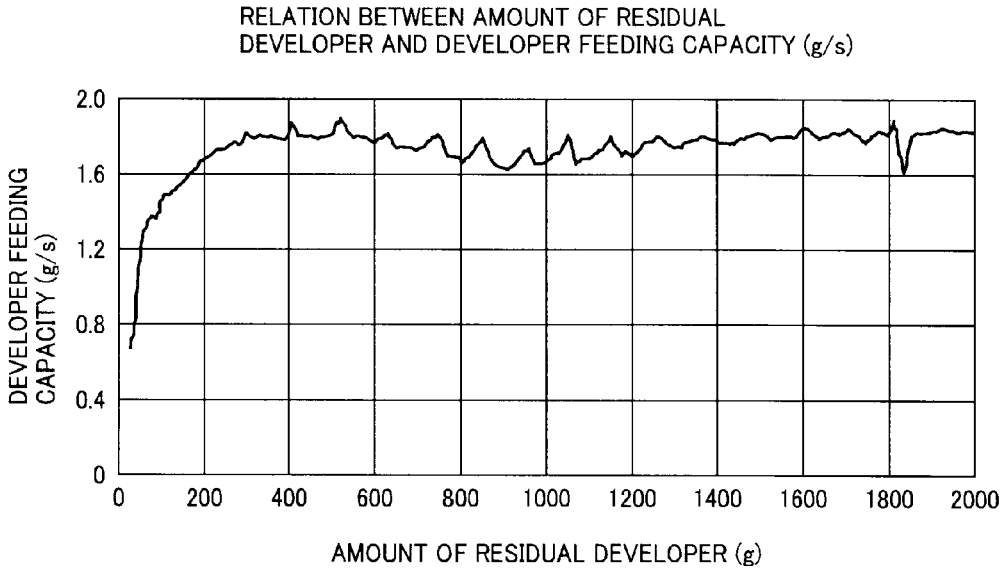
FIG. 15 is a graph showing the relation between the amount of residual developer and the developer feeding capacity of a developer supplying device.

FIG. 13 is a graph showing the relation between the carrier concentration and the output from the sensor, and FIG. 14 is a graph showing the relation between the amounts of residual developers (black and magenta developers) and the output from the sensor. Since the sensor 143 detects the permeability of developer including a toner and a carrier, the output therefrom increases as the carrier concentration increases. Therefore, the amount of supplementary developer remaining in a developer bottle set in the image forming apparatus can be estimated, and the near-end and end of the developer in the developer bottle can be determined on the basis of the output from the sensor 143. Namely, when the output from the sensor increases and then decreases to a certain value (for example, 1.0V), it can be determined that the supplementary developer in the developer bottle is in an end state.

Next, the sensor detection processing will be described with reference to FIGS. 16-18.

Figure 16:
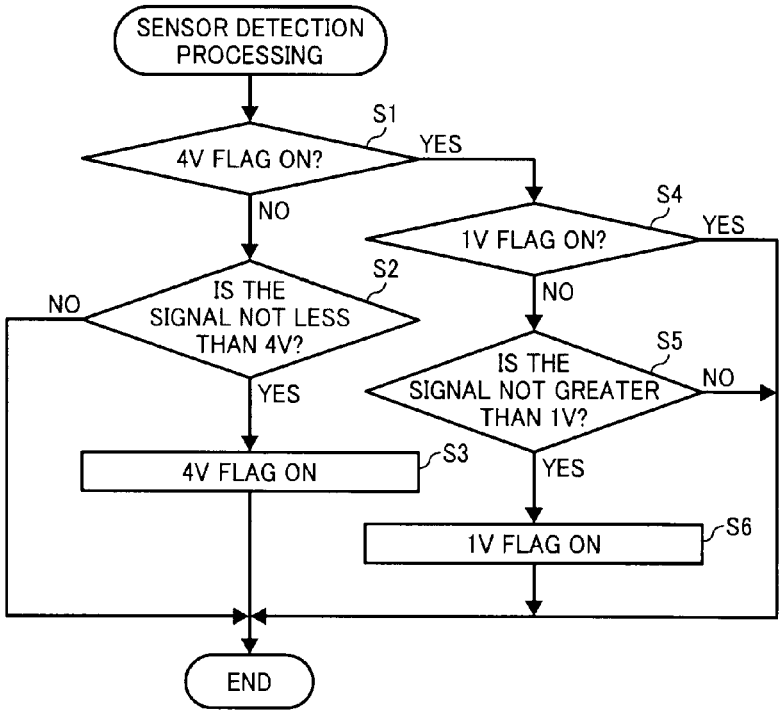
FIG. 16 is a flowchart illustrating the sensor detection processing for use in the image forming apparatus of the present invention.

Referring to FIG. 16, in step 1 (hereinafter referred to as S1 (i.e., step is referred to as "S")), it is judged whether a 4V flag present in a predetermined region of a RAM is ON. If the 4V flag is not ON (NO in S1), then it is judged whether the signal from the sensor is not less than 4V (S2). If the signal from the sensor is less than 4V (NO in S2), this processing is ended. If the signal from the sensor is not less than 4V (YES in S2), the 4V flag is turned ON in S3, and the processing is then ended.

If the 4V flag is ON (YES in S1), then it is judged whether the 1V flag is ON (S4). If the 1V flag is ON (YES in S4), this processing is ended. If the 1V flag is not ON (NO in S4), then it is judged whether the signal from the sensor is not greater than 1V (S5). If the signal is greater than 1V (NO in S5), this processing is ended. In addition, if the signal from the sensor is not greater than 1V (YES in S5), the 1V flag is turned ON in S6, and the processing is then ended.

Next, an end display processing 1 will be described.

Figure 17A:
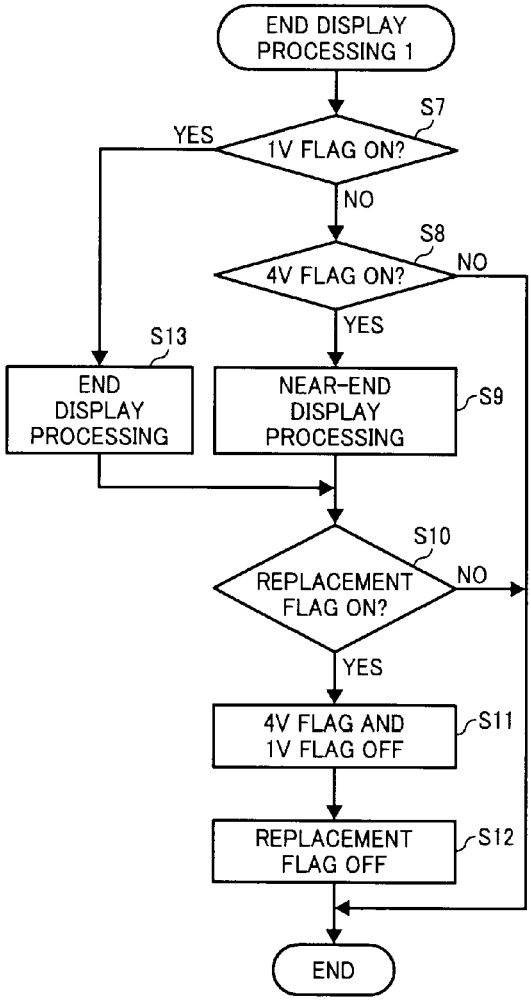
FIGS. 17A and 17B are flowcharts illustrating the end displaying processings for use in the image forming apparatus of the present invention.

Referring to FIG. 17A, at first it is judged whether the 1V flag is ON in S7. If the 1V flag is not ON (NO in S7), then it is judged whether the 4V flag is ON in S8. If the 4V flag is not ON (NO in S8) (i.e., each the 1V flag and the 4V flag is in an OFF state), the processing is ended. If the 4V flag is ON (YES in S8), the near-end display processing such that an user is notified that the supplementary developer is in a near-end state is performed in S9. The near-end display can be made, for example, by a method in which the information is indicated in the display 145 (such as liquid crystal displays) provided on the image forming apparatus; a method in which a LED corresponding to the portion (i.e., developer bottle) is lighted; or a method in which the information is conveyed to a user in voice.

Next, it is judged whether the replacement flag (described below) is ON in S10. If the replacement flag is not ON (NO in S10), the processing is ended. If the replacement flag is ON (YES in S10), then the 4V flag and the 1V flag are turned OFF in S11. Namely, when the developer bottle 150 is replaced, the flags are reset and return to the initial state. In addition, the replacement flag is turned OFF in S12. If the 1V flag is ON (YES in S7), the end display processing such that a user is notified that the supplementary developer is in an end state is performed in S13. The end display can be made by such methods as mentioned above for use in near-end display.

Next, an end display processing 2 will be described.

Figure 17B:
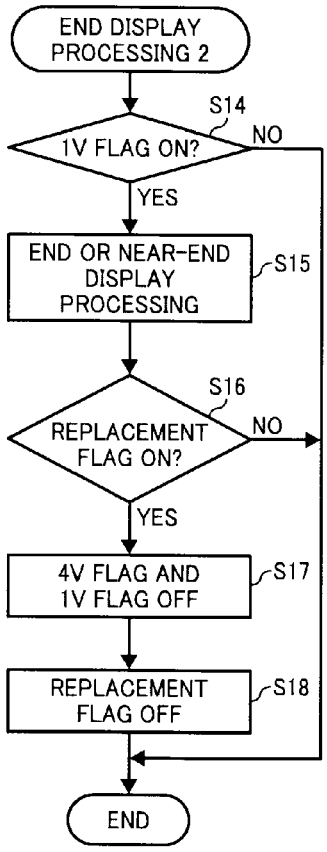

Referring to FIG. 17B, at first it is judged whether the 1V flag is ON in S14. If the 1V flag is not ON (NO in S14), the processing is ended. If the 1V flag is ON (YES in S14), the end display processing (or near-end display processing) such that a user is notified that the supplementary developer is in an end state (or near-end state) is performed in S15. The end display (or near-end display) can be made by such methods as mentioned above for use in near-end display. In this example, the end display processing is performed, but the near-end display processing may be performed. In addition, the same operations as performed in S10-S12 are performed in S16-S18.

Next, the replacement detection processing will be described.

Figure 18:
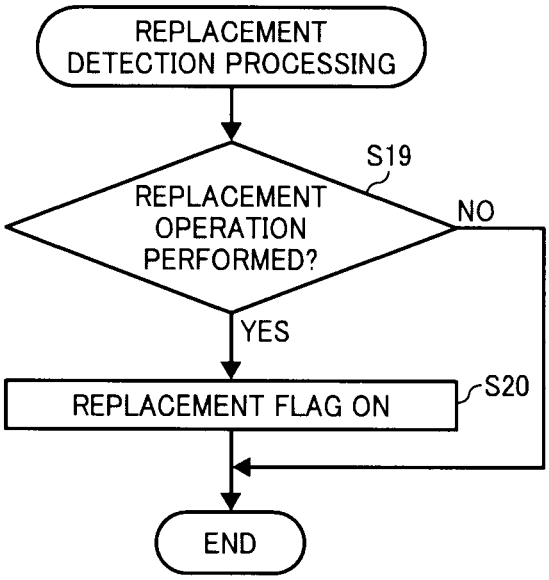
FIG. 18 is a flowchart illustrating the replacement detection processing for use in the image forming apparatus of the present invention.

Referring to FIG. 18, it is judged whether the developer bottle 150 is replaced in S19. In this regard, for example, the following method is used for the judgment. Specifically, at first extraction of the developer bottle 150 is detected. When a developer bottle is inserted thereafter, the information on the developer bottle is read from the above-mentioned information storage device such as IC chips to determine whether the developer bottle is a new developer bottle. If the inserted developer bottle is a new developer bottle, it is judged that the developer bottle replacement operation is correctly performed. In this regard, the information storage device stores information on the type of the developer, lot number, number of recycling operations that the developer bottle is subjected, etc., as mentioned above.

If it is judged that the replacement operation is performed (YES in S19), the replacement flag is turned ON in S20.

It is possible to write information such that the supplementary developer in the developer bottle is in an end or near-end state in the storage device provided on the developer bottle before or after the end or near-end display is made in S13, S9, 515, etc. By using this method, it becomes possible to judge that the developer bottle replacement has been performed by confirming that such end information is not written in the set developer bottle in a replacement operation. In addition, in case a developer bottle in an end or near-end state is mistakenly set to the image forming apparatus, the end or near-end display can be rapidly made by using the method.

In addition, it is possible to write the 1V flag and 4V flag in the information storage device of the developer bottle instead of a RAM provided in the image forming apparatus. In this case, the storage location is set on the information storage device of the developer bottle. By using this method, it is not necessary to perform the operations of S10-S12 in the end display processing 1 and S16-S18 in the end display processing 2.

By performing the above-mentioned processings of from the sensor detection processing to the replacement detection processing, the following can be realized.

At first, it becomes possible from the sensor detection processing to determine whether the concentration of the carrier in the supplementary developer fed through the feeding tube reaches a predetermined first concentration (for example, about 21% (i.e., a peak value)), and whether the carrier concentration reaches the first concentration and then decreases to a predetermined second concentration (for example, about 5% (i.e., an end or near-end value)). In reality, the judgments are made on the basis of the sensor's outputs (4V and 1V), but the purpose thereof is to judge the carrier concentration.

In the above-mentioned end display processing 1, it is judged that the developer bottle 150 feeding a supplementary developer, whose carrier concentration reaches the predetermined first concentration and then decreases to the second concentration, is considered that the amount of the supplementary developer therein is smaller than the predetermined amount, and is considered to be replaced. Therefore, the end display is made. If it is judged that the carrier concentration reaches the predetermined first concentration but does not decrease to the second concentration, the near-end display is made while issuing a warning.

In the above-mentioned end display processing 2, warning is not issued in the case where the carrier concentration reaches the predetermined first concentration but does not decrease to the second concentration (although the near-end display is made in the end display processing 1). When the carrier concentration decreases to the second concentration, the end display or near-end display is made. Image forming apparatus performing this end display processing 2 preferably have a hopper, which is located between the developer bottle and the developing device to contain a considerable amount of developer. By providing such a hopper, the developing device can use the developer present in the hopper for development even when the developer in the developer bottle is substantially exhausted. Namely, even if end display or near-end display is made when the developer in the developer bottle is substantially exhausted, the user can perform the developer bottle replacement operation with considerably sufficient lead time. Needless to say, such a hopper is not essential f or the image forming apparatus of the present invention. By properly setting the second carrier concentration, and/or properly determining the amount of supplementary developer contained in the developer bottle, the end display processing 2 can be well performed.

Needless to say, the above-mentioned replacement detection processing is made to judge whether the developer bottle is replaced, and is a trigger for cancelling of the end or near-end display.

This document claims priority and contains subject matter related to Japanese Patent Applications Nos. 2009-169845 and 2010-102321, filed on Jul. 21, 2009 and Apr. 27, 2010, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developer supplying device comprising:

a supplementary developer container configured to contain a supplementary developer including a toner and a carrier mixed in a predetermined ratio, wherein the supplementary developer container is replaceable;

a supplementary developer feeding passage configured to feed the supplementary developer from the supplementary developer container to a developing device;

a carrier concentration determining device, which is provided on the supplementary developer feeding passage to determine concentration of the carrier in the supplementary developer fed through the supplementary developer feeding passage; and a residual supplementary developer amount estimating device configured to estimate an amount of the supplementary developer remaining in the supplementary developer container on the basis of the carrier concentration, wherein the residual supplementary developer amount estimating device determines at least one of an end state and a near-end state of the supplementary developer in the supplementary developer container when the carrier concentration determined by the carrier concentration determining device reaches a predetermined first carrier concentration and then reaches a predetermined second carrier concentration lower than the predetermined first carrier concentration.

2. The developer supplying device according to claim 1, wherein the residual supplementary developer amount estimating device determines at least one of an end state and a near-end state of the supplementary developer in the supplementary developer container depending on the carrier concentration determined by the carrier concentration determining device.

3. The developer supplying device according to claim 1, wherein the predetermined first carrier concentration is a peak value of the carrier concentration.

4. The developer supplying device according to claim 1, wherein the carrier concentration determining device determines the carrier concentration by measuring permeability of the supplementary developer fed through the supplementary developer feeding passage.

5. The developer supplying device according to claim 1, wherein the carrier concentration determining device determines the carrier concentration without contacting the supplementary developer.

6. The developer supplying device according to claim 1, wherein the carrier concentration determining device is arranged on a horizontally extending portion of the supplementary developer feeding passage.

7. The developer supplying device according to claim 1, further comprising:

a pump which feeds the supplementary developer through the supplementary developer feeding passage utilizing pressure difference.

8. The developer supplying device according to claim 7, wherein the pump is a single-axis eccentric screw pump.

9. A developing device comprising:

a developer supplying device according to claim 1;

a developer containing portion configured to contain a developer, wherein the supplementary developer is supplied from the supplementary developer container to the developer containing portion by the developer supplying device to be mixed with the developer;

an agitating member configured to agitate and feed the developer in the developer container portion; and a developer bearing member configured to bear the developer to develop an electrostatic latent image with the developer.

10. An image forming apparatus comprising:

an image bearing member configured to bear an electrostatic latent image thereon; and the developing device according to claim 9 configured to develop the electrostatic latent image with the developer to form a visual image on the image bearing member.

11. The developer supplying device according to claim 1, wherein the residual supplementary developer amount estimating device determines the at least one of the end state and the near-end state of the supplementary developer in the supplementary developer container when the carrier concentration determined by the carrier concentration determining device increases to the predetermined first carrier concentration and then decreases to the predetermined second carrier concentration.

12. The developer supplying device according to claim 1, wherein the residual supplementary developer amount estimating device determines the at least one of the end state and the near-end state of the supplementary developer in the supplementary developer container when the carrier concentration determined by the carrier concentration determining device increases.

* * * * *